US012687359B1

(12) United States Patent
Kloepfer et al.

(10) Patent No.: US 12,687,359 B1
(45) Date of Patent: Jul. 21, 2026

(54) SYSTEMS AND TECHNIQUES FOR MANAGING A FLEET OF USER-AUTHENTICATED GUNS

(71) Applicant: Biofire Technologies Inc., Broomfield, CO (US)

(72) Inventors: Kai Thorin Kloepfer, Denver, CO (US); Christopher James Owens, Denver, CO (US)

(73) Assignee: Biofire Technologies Inc., Broomfield, CO (US)

( * ) Notice: Subject to any disclaimer, the term of this patent is extended or adjusted under 35 U.S.C. 154(b) by 125 days.

(21) Appl. No.: 18/480,262

(22) Filed: Oct. 3, 2023

Related U.S. Application Data

(60) Provisional application No. 63/378,314, filed on Oct. 4, 2022.

(51) Int. Cl.
*F41A 17/06* (2006.01)

(52) U.S. Cl.
CPC ..... *F41A 17/063* (2013.01); *F41A 17/066* (2013.01)

(58) Field of Classification Search
CPC ..... F41A 17/063; F41A 17/066; F41A 17/46; F41A 17/08; F41A 17/38; F41A 9/65; F41A 17/06; F41A 17/34; F41A 17/36; F41A 9/62; F41A 17/48; F41A 35/06; F41A 21/48; F41A 11/02; F41C 23/16; F41C 23/14; F41B 11/62; F41B 11/73
USPC ..... 42/70.11, 70.01, 70.02, 6, 69.01
See application file for complete search history.

(56) References Cited

U.S. PATENT DOCUMENTS

| | | | | |
|---|---|---|---|---|
| 6,286,242 | B1 * | 9/2001 | Klebes | F41A 19/58 42/84 |
| 6,360,468 | B1 * | 3/2002 | Constant | F41A 17/066 42/84 |
| 7,823,681 | B2 * | 11/2010 | Crespo | A61B 5/082 340/576 |
| 8,380,174 | B2 * | 2/2013 | Vander Veen | H04M 1/72433 455/418 |
| 9,644,912 | B2 * | 5/2017 | Milde, Jr. | F41A 17/063 |
| 9,857,133 | B1 * | 1/2018 | Kloepfer | G06F 21/32 |
| 10,355,875 | B1 * | 7/2019 | Fields | G06F 3/017 |
| 11,163,863 | B2 * | 11/2021 | Ben Bouazza | G06F 16/2455 |
| 11,257,502 | B2 * | 2/2022 | Himmelstein | G10L 17/08 |
| 11,326,847 | B1 * | 5/2022 | Bango | F41A 17/063 |
| 11,474,675 | B2 * | 10/2022 | Mueller | G06F 3/0484 |

(Continued)

*Primary Examiner* — Michael D David
(74) *Attorney, Agent, or Firm* — Perkins Coie LLP; Andrew T. Pettit

(57) ABSTRACT

The present disclosure provides systems and techniques for managing a fleet of user-authenticated guns. A device, such as a configuration device, may determine that an administrator is authorized to configure a gun. The device may generate a user interface including multiple digital assets, where each digital asset of the multiple digital assets represents a respective human user. The device may collect user input from the administrator indicating that a human user, represented by a digital asset of the multiple digital assets, is selected as an authorized operator of the gun. The device may generate a configuration message and transmit the configuration message to the gun, where the configuration message is designed to configure the gun to allow the human user to operate the gun and prevent other human users from operating the gun.

10 Claims, 13 Drawing Sheets

(56) References Cited

U.S. PATENT DOCUMENTS

| | | | | |
|---|---|---|---|---|
| 11,785,652 | B2 * | 10/2023 | Stanek | H04W 4/06 370/329 |
| 11,900,742 | B1 * | 2/2024 | Kloepfer | F41A 17/063 |
| 11,920,881 | B1 * | 3/2024 | Kloepfer | F41A 19/01 |
| 12,007,187 | B1 * | 6/2024 | Thiesen | G01R 29/24 |
| 12,080,118 | B1 * | 9/2024 | Thiesen | F41A 17/066 |
| 12,332,716 | B1 * | 6/2025 | Owens | G06F 1/3287 |
| 2002/0170220 | A1 * | 11/2002 | Recce | B60R 25/2045 42/70.08 |
| 2008/0147953 | A1 * | 6/2008 | Lawandus | H04L 63/0861 710/313 |
| 2011/0056108 | A1 * | 3/2011 | McCord | F41A 17/066 40/633 |
| 2012/0291327 | A1 * | 11/2012 | Boutot, Jr. | F41C 33/06 42/70.11 |
| 2016/0353153 | A1 * | 12/2016 | Seidel | H04N 21/485 |
| 2017/0076294 | A1 * | 3/2017 | Kojima | G06F 21/32 |
| 2017/0292804 | A1 * | 10/2017 | Lyren | F41A 17/063 |
| 2018/0149440 | A1 * | 5/2018 | Mireus | G01S 19/13 |
| 2018/0285881 | A1 * | 10/2018 | Lee | G06Q 20/40145 |
| 2019/0178595 | A1 * | 6/2019 | Hafen | F41A 17/063 |
| 2022/0042767 | A1 * | 2/2022 | Cosico | G07C 9/00563 |
| 2022/0307789 | A1 * | 9/2022 | Kloepfer | F41A 17/56 |
| 2022/0333888 | A1 * | 10/2022 | Kloepfer | F41A 19/59 |
| 2022/0341702 | A1 * | 10/2022 | Owens | F41A 17/06 |
| 2022/0373284 | A1 * | 11/2022 | Thiesen | F41A 19/59 |
| 2023/0014931 | A1 * | 1/2023 | Kelley | F41A 19/59 |
| 2024/0095697 | A1 * | 3/2024 | Singh | G06Q 20/357 |
| 2024/0320314 | A1 * | 9/2024 | Freund | G07C 9/00563 |

* cited by examiner

100

200

300

400

600

700

800

1000

1100

1200

1300

SYSTEMS AND TECHNIQUES FOR MANAGING A FLEET OF USER-AUTHENTICATED GUNS

CROSS-REFERENCE TO RELATED APPLICATIONS

This application claims priority to U.S. Provisional Application No. 63/378,314, titled "SYSTEMS AND TECHNIQUES FOR MANAGING A FLEET OF USER-AUTHENTICATED GUNS" and filed on Oct. 4, 2022, which is incorporated by reference herein in its entirety.

FIELD OF TECHNOLOGY

The teachings disclosed herein generally relate to guns, and more specifically to user-authenticated guns.

BACKGROUND

The term "gun" generally refers to a ranged weapon that uses a shooting tube (also referred to as a "barrel") to launch solid projectiles, though some instead project pressurized liquid, gas, or even charged particles. These projectiles may be free flying (e.g., as with bullets), or these projectiles may be tethered to the gun (e.g., as with spearguns, harpoon guns, and electroshock weapons such as TASER® devices). The means of projectile propulsion vary according to the design (and thus, type of gun), but are traditionally effected pneumatically by a highly compressed gas contained within the barrel. This gas is normally produced through the rapid exothermic combustion of propellants (e.g., as with firearms) or mechanical compression (e.g., as with air guns). When introduced behind the projectile, the gas pushes and accelerates the projectile down the length of the barrel, imparting sufficient launch velocity to sustain it further towards a target after exiting the muzzle.

Most guns use compressed gas that is confined by the barrel to propel the projectile up to high speed, though the term "gun" may be used more broadly in relation to devices that operate in other ways. Accordingly, the term "gun" may not only cover handguns, shotguns, rifles, single-shot firearms, semi-automatic firearms, and automatic firearms, but also electroshock weapons, light-gas guns, plasma guns, and the like.

Significant energies have been spent developing safer ways to use, transport, store, and discard guns. Gun safety is an important aspect of avoiding unintentional injury due to mishaps like accidental discharges and malfunctions. Gun safety is also becoming an increasingly important aspect of designing and manufacturing guns. While there have been many attempts to make guns safer to use, transport, and store, those attempts have had little impact.

SUMMARY

The systems and techniques described herein support configuring one or more guns. The term "gun," as used herein, may be used to refer to a lethal force weapon, such as a pistol, a rifle, a shotgun, a semi-automatic firearm, or an automatic firearm; a less-lethal weapon, such as a stun-gun or a projectile emitting device; or an assembly of components operable to selectively discharge matter or charged particles, such as a firing mechanism.

Generally, the systems and techniques described herein provide for configuring a gun to allow a human user to operate the gun. For example, a device may determine that an administrator is authorized to configure a gun. The device may generate a user interface including multiple digital assets, where each digital asset of the multiple digital assets represents a respective human user. The device may collect user input from the administrator indicating that a human user, represented by a digital asset of the multiple digital assets, is selected as an authorized operator of the gun. The device may generate a configuration message and transmit the configuration message to the gun, where the configuration message is designed to configure the gun to allow the human user to operate the gun and prevent other human users from operating the gun.

Figure 1:
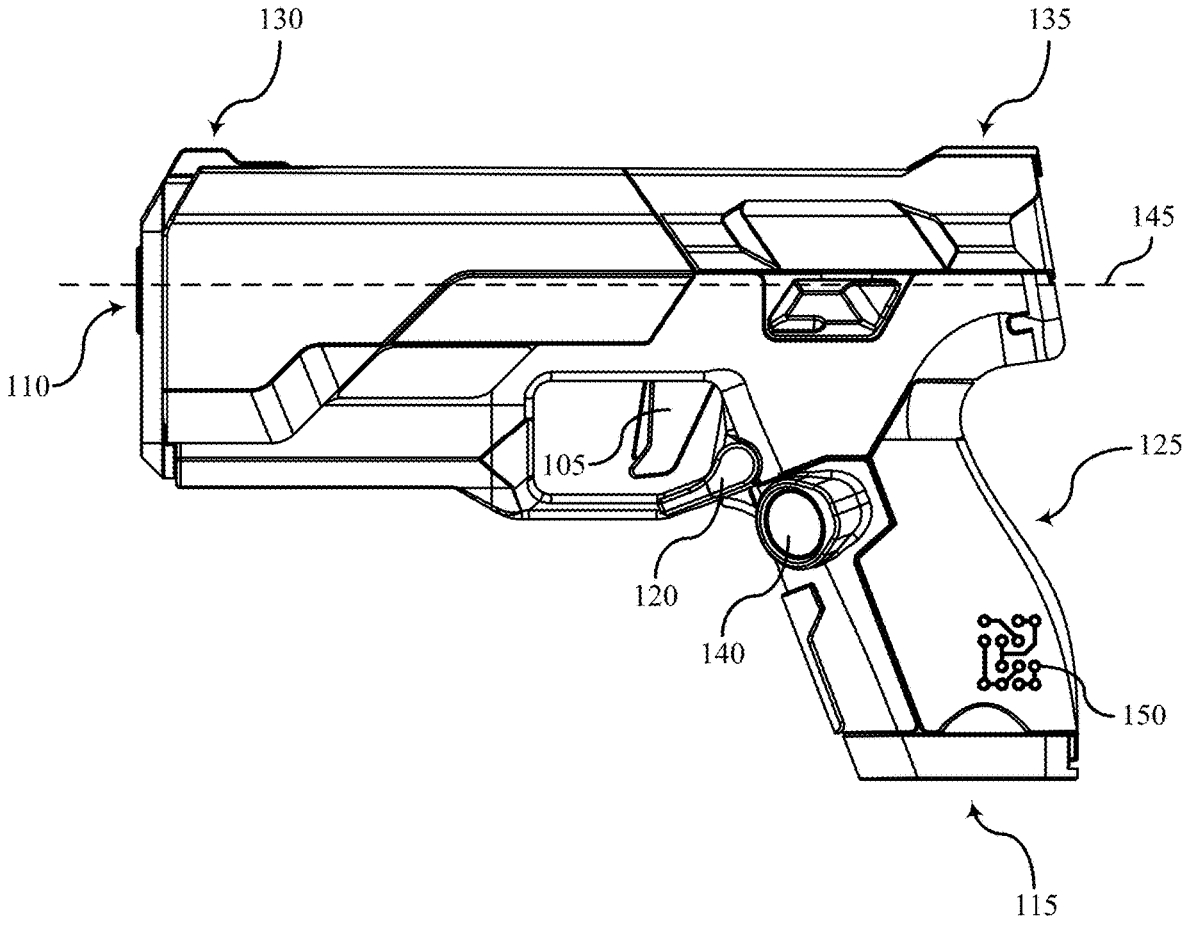
FIG. 1 illustrates an example of a user-authenticated gun.

Various features of the technology described herein will become more apparent to those skilled in the art from a study of the Detailed Description in conjunction with the drawings. Various embodiments are depicted in the drawings for the purpose of illustration. However, those skilled in the art will recognize that alternative embodiments may be employed without departing from the principles of the technology. Accordingly, the technology is amenable to modifications that may not be reflected in the drawings.

DETAILED DESCRIPTION

Law enforcement personnel respond to situations associated with varying levels violence on a regular basis. As such, most law enforcement personnel are equipped with firearms so they can protect not only themselves, but also the public at large. Most law enforcement personnel carry a conventional firearm so as to be able to respond to situations that may require lethal force. Because a situation requiring lethal force may arise at any moment, law enforcement personnel are generally in constant possession of a conventional firearm, but this means that law enforcement personnel must be vigilant in all situations, even those that do not demand lethal force, as a nefarious individual may attempt to get ahold of the firearm and use it against the officer or the public. As such, one benefit of a user-authenticated gun is the reduction of risk in the scenario where a nefarious individual takes a gun from an officer, as user-authenticated guns are designed to function only for select individuals, such as the law enforcement officer.

Managing a fleet of firearms, such as a fleet of firearms used by a law enforcement agency, is challenging and requires the maintenance of accurate records for hundreds of firearms. Managing a fleet of conventional user-authenticated guns is expensive and often demands a lot of time to configure the gun. For example, a conventional user-authenticated gun may only allow one individual to be authorized as an approved operator of the gun, so a gun may need to be purchased for each individual in an organization, even if some individuals only use the gun during select hours of the day. As another example, a conventional user-authenticated gun may require a configuration process to be performed each time an individual is added as an approved user or removed as an approved operator, and the induvial may need to be in possession of the gun each time the configuration process is performed.

Introduced here, therefore, are systems and techniques for managing a fleet of user-authenticated guns. An administrator may use a device (e.g., a computer, a docking station, a smartphone, etc.) to configure aspects of a fleet of user-authenticated guns. For example, the administrator may login to the device and perform a configuration procedure to configure who is permitted to operate which guns, when the guns may be used, where the guns may be used, how the guns authenticate a potential operator, or the like. The device may be coupled with both a data store and one or more user-authenticated guns, and the device may cause a gun to be configured according to the configuration procedure. For example, authentication data may be transferred from the data store to a gun as part of the configuration procedure, and an officer may operate the gun by providing authentication data that matches the authentication data stored on the gun. Authentication data may include biometric data (e.g., fingerprint data, palmprint data, iris data, facial data, vein pattern data, voice data, etc.), token data (e.g., a digital signature, a password, a near-field communication (NFC) identifier, a Bluetooth token, a radio-frequency identification (RFID) tag, etc.), or both. Authentication data may be referred to as enrollment data when used to enroll a user (e.g., an administrator or an operator of a gun), and authentication data may be referred to as query data when used to authenticate a user. A gun may store enrollment data and authorize a user to operate the gun in response to receiving query data that matches the enrollment data.

A data store may obtain authentication data for a group of human users (which many be referred to as "operators"). An operator is a person who is intended to be able to use the gun, such as a law enforcement person, an owner of the gun, or any person who the owner of the gun wants to allow to use the gun. The authentication data may be collected via a user-authenticated gun, a biometric data sensor, an antenna, or the like, and the authentication data may be transformed (e.g., encrypted, hashed, encoded, obfuscated, etc.) prior to storage such that the transformed version of the authentication data is stored in the data store. An administrator may use a device to configure one or more user-authenticated guns. As an illustrative example, the administrator may login to the device and provide user input to the device indicating that officer Smith is permitted to operate the gun at any point during the year 2022. The administrator may also provide user input so as to configure the gun to authenticate officer Smith based on a user authentication procedure verifying both facial data and RFID data.

The data store may store authentication data for multiple operators, and the administrator may configure multiple user-authenticated guns. For example, the administrator may provide user input indicating which officers can operate which guns and authentication data may be transferred from the data store to the guns accordingly. The device may connect to a gun via a wireless interface or via a wired interface, and the device may connect to multiple guns simultaneously. Being able to connect to multiple guns allows the administrator to configure multiple guns in a time efficient manner, thereby reducing the burden of configuring multiple guns.

In some examples, a user-authentication gun may include a wireless communication interface, and an administrator may modify the configuration of the gun in real-time. As an example, the administrator may identify a lethal-threat scenario and unlock the gun such that the gun is operational and does not need to perform a user authentication procedure to function. As another example, the administrator may lock the gun such that the gun will not function for anybody in response to identifying that the officer has lost the gun or has been fired. Such wireless capabilities improve the safety of the guns and mitigates the risk associated with a lost gun falling into the wrong hands.

Embodiments may be described in the context of executable instructions for the purpose of illustration. For example, a processor housed in a gun may be described as being capable of executing instructions that permit the user to be authenticated based on authentication data, such as fingerprint data, iris data, a password, or an RFID tag. However, those skilled in the art will recognize that aspects of the technology could be implemented via hardware, firmware, or software.

Terminology

References in the present disclosure to "an embodiment" or "some embodiments" means that the feature, function, structure, or characteristic being described is included in at least one embodiment. Occurrences of such phrases do not necessarily refer to the same embodiment, nor are they necessarily referring to alternative embodiments that are mutually exclusive of one another.

Unless the context clearly requires otherwise, the terms "comprise," "comprising," and "comprised of" are to be construed in an inclusive sense rather than an exclusive or exhaustive sense (i.e., in the sense of "including but not limited to"). The term "based on" is also to be construed in an inclusive sense rather than an exclusive or exhaustive sense. For example, the phrase "A is based on B" does not imply that "A" is based solely on "B." Thus, the term "based on" is intended to mean "based at least in part on" unless otherwise noted.

The terms "connected," "coupled," and variants thereof are intended to include any connection or coupling between two or more elements, either direct or indirect. The connection or coupling can be physical, electrical, logical, or a combination thereof. For example, elements may be electrically or communicatively coupled with one another despite not sharing a physical connection. As one illustrative example, a first component is considered coupled with a second component when there is a conductive path between the first component and the second component. As another illustrative example, a first component is considered coupled with a second component when the first component and the second component are fastened, joined, attached, tethered, bonded, or otherwise linked.

The term "manager" may refer broadly to software, firmware, or hardware. Managers are typically functional components that generate one or more outputs based on one or more inputs. A computer program may include or utilize one or more managers. For example, a computer program may utilize multiple managers that are responsible for completing different tasks, or a computer program may utilize a single manager that is responsible for completing all tasks. As another example, a manager may include an electrical circuit that produces an output based on hardware components, such as transistors, logic gates, analog components, or digital components. Unless otherwise noted, the terms "manager" and "module" may be used interchangeably herein.

When used in reference to a list of multiple items, the term "or" is intended to cover all of the following interpretations: any of the items in the list, all of the items in the list, and any combination of items in the list. For example, the list "A, B, or C" indicates the list "A" or "B" or "C" or "A and B" or "A and C" or "B and C" or "A and B and C."

Overview of Guns

FIG. 1 illustrates an example of a gun 100 that supports systems and techniques for managing a fleet of user-authenticated guns. The gun 100 includes a trigger 105, a barrel 110, a magazine 115, and a magazine release 120. While these components are generally found in firearms, such as pistols, rifles, and shotguns, those skilled in the art will recognize that the technology described herein may be similarly appliable to other types of guns as discussed above. As an example, comparable components may be included in vehicle-mounted weapons that are not intended to be held or operated by hand. While not shown in FIG. 1, the gun 100 may also include a striker (e.g., a ratcheting striker or rotating striker) or a hammer that can be actuated in response to pulling the trigger 105. Pulling the trigger 105 may result in the release of the striker or hammer, thereby causing the striker or hammer to contact a firing pin, percussion cap, or primer, so as to ignite a propellant and fire a projectile through the barrel 110. Embodiments of the gun 100 may also include a blowback system, a locked breech system, or any combination thereof. These systems are more commonly found in self-reloading firearms. The blowback system may be responsible for obtaining energy from the motion of the case of the projectile as it is pushed to the rear of the gun 100 by expanding propellant, while the locked breech system may be responsible for slowing down the opening of the breech of a self-reloading firearm when fired. Accordingly, the gun 100 may support the semi-automatic firing of projectiles, the automatic firing of projectiles, or both.

The gun 100 may include one or more safeties that are meant to reduce the likelihood of an accidental discharge or an unauthorized use. The gun 100 may include one or more mechanical safeties, such as a trigger safety or a firing pin safety. The trigger safety may be incorporated in the trigger 105 to prevent the trigger 105 from moving in response to lateral forces placed on the trigger 105 or dropping the gun. The term "lateral forces," as used herein, may refer to a force that is substantially orthogonal to a central axis 145 that extends along the barrel 110 from the front to the rear of the gun 100. The firing pin safety may block the displacement path of the firing pin until the trigger 105 is pulled. Additionally or alternatively, the gun 100 may include one or more electronic safety components, such as an electronically actuated drop safety. In some cases, the gun 100 may include both mechanical and electronic safeties to reduce the potential for an accidental discharge and enhance the overall safety of the gun 100.

The gun 100 may include one or more sensors, such as a user presence sensor 125 and a biometric sensor 140. In some cases, the gun 100 may include multiple user presence sensors 125 whose outputs can collectively be used to detect the presence of a user. For example, the gun 100 may include a time of flight (TOF) sensor, a photoelectric sensor, a capacitive sensor, an inductive sensor, a force sensor, a resistive sensor, or a mechanical switch. As another example, the gun 100 may include a proximity sensor that is configured to emit an electromagnetic field or electromagnetic radiation, like infrared, and looks for changes in the field or return signal. As another example, the gun 100 may include an inertial measurement unit (IMU) configured to identify a presence event in response to measuring movement that matches a movement signature of a user picking up the gun 100. As another example, the gun 100 may include an audio input mechanism (e.g., a transducer implemented in a microphone) that is configured to generate a signal that is representative of nearby sounds, and the presence of the user can be detected based on an analysis of the signal.

The gun 100 may also include one or more biometric sensors 140 as shown in FIG. 1. For example, the gun 100 may include a fingerprint scanner (also referred to as a "fingerprint scanner"), an image sensor, or an audio input mechanism. The fingerprint scanner may generate a digital image (or simply "image") of the fingerprint pattern of the user, and the fingerprint pattern can be examined (e.g., on the gun 100 or elsewhere) to determine whether the user should be verified. The image sensor may generate an image of an anatomical feature (e.g., the face or eye) of the user, and the image can be examined (e.g., on the gun 100 or elsewhere) to determine whether the user should be verified. Normally, the image sensor is a charge-coupled device (CCD) or complementary metal-oxide semiconductor (CMOS) sensor that is included in a camera module (or simply "camera") able to generate color images. The image sensor need not necessarily generate images in color, however. In some embodiments, the image sensor is configured to generate ultraviolet, infrared, or near infrared images. Regardless of its nature, images generated by the image sensor can be used to authenticate the presence or identity of the user. As an example, an image generated by a camera may be used to perform facial recognition of the user. The audio input mechanism may generate a signal that is representative of audio containing the voice of the user, and the signal can be examined (e.g., on the gun 100 or elsewhere) to determine whether the user should be verified. Thus, the signal generated by the audio input mechanism may be used to perform speaker recognition of the user. Including multiple biometric sensors in the gun 100 may support a robust authentication procedure that functions in the event of sensor failure, thereby improving gun reliability. Note, however, that each of the multiple biometric sensors may not provide the same degree or confidence of identity verification. As an example, the output produced by one biometric sensor (e.g., an audio input mechanism) may be used to determine whether a user is present while the output produced by another biometric sensor (e.g., a fingerprint scanner or image sensor) may be used to verify the identity of the user in response to a determination that the user is present.

The gun 100 may include one or more components that facilitate the collection and processing of token data. For example, the gun 100 may include an integrated circuit (also referred to as a "chip") that facilitates wireless communication. The chip may be capable of receiving a digital identifier, such as a Bluetooth® token or a Near Field Communication (NFC) identifier. The term "authentication data" may be used to described data that is used to authenticate a user. For example, the gun 100 may collect authentication data from the user to determine that the user is authorized to operate the gun 100, and the gun 100 may be unlocked based on determining that the user is authorized to operate the gun 100. Authentication data may include biometric data, token data, or both. Authentication data may be referred to as enrollment data when used to enroll a user, and authentication data may be referred to as query data when used to authenticate a user. In some examples, the gun may transform (e.g., encrypt, hash, transform, encode, etc.) enrollment data and store the transformed enrollment data in memory (e.g., non-volatile memory) of the gun, and the gun may discard or refrain from storing query data in the memory. Thus, the gun 100 may transform authentication data, so as to inhibit unauthenticated use even in the event of unauthorized access of the gun.

As an example, the gun 100 may include a wireless communication interface 150. The wireless communication interface 150 may be an example of an integrated circuit that facilitates over-the-air communication according to one or more protocols, such as Bluetooth, RFID, NFC, Zigbee, Wi-Fi, LTE, 5G, 4G, 3G, etc. The wireless communication interface 150 may support collecting token data for use in user enrollment procedure and user authentication procedures. The wireless communication interface 150 may support receiving data from a configuration device, such as receiving configuration messages that are structured so as to configure aspects of the gun 100. The wireless communication interface 150 may also support receiving software updates over-the-air.

The gun 100 may support various types of aiming sights (or simply "sights"). At a high level, a sight is an aiming device that may be used to assist in visually aligning the gun 100 (and, more specifically, its barrel 110) with a target. For example, the gun 100 may include iron sights that improve aim without the use of optics. Additionally or alternatively, the gun 100 may include telescopic sights, reflex sights, or laser sights. In FIG. 1, the gun 100 includes two sights—namely, a front sight 130 and a rear sight 135. In some cases, the front sight 130 or the rear sight 135 may be used to indicate gun state information. For example, the front sight 130 may include a single illuminant that is able to emit light of different colors to indicate different gun states. As another example, the front sight 130 may include multiple illuminants, each of which is able to emit light of a different color, that collectively are able to indicate different gun states. One example of an illuminant is a light-emitting diode (LED).

The gun 100 may fire projectiles, and the projectiles may be associated with lethal force or less-lethal force. For example, the gun 100 may fire projectiles containing lead, brass, copper, zinc, steel, plastic, rubber, synthetic polymers (e.g., nylon), or a combination thereof. In some examples, the gun 100 is configured to fire lethal bullets containing lead, while in other cases the gun 100 is configured to fire less-lethal bullets containing rubber. As mentioned above, the technology described herein may also be used in the context of a gun that fires prongs (also referred to as "darts") which are intended to contact or puncture the skin of a target and then carry electric current into the body of the target. These guns are commonly referred to as "electronic control weapons" or "electroshock weapons." One example of an electroshock weapon is a TASER device.

As further discussed herein, aspects of the gun 100 may be configured by an administrator. The administrator may use a user interface (UI) displayed by a device to configure the gun 100, and the gun 100 may be electronically coupled with the device. In some examples, the gun 100 may be physically coupled with the device via a wired communication channel (e.g., a conductive wire, a bus, a USB cable, etc.) while in some other examples, the gun 100 may be virtually coupled with the device via a wireless communication channel (e.g., a radio-frequency band, a wireless communication protocol, etc.). The device may determine that the administrator is authorized to configure the gun 100 by matching first query data to first enrollment data, generate a user interface that includes multiple assets representing multiple guns, where the multiple guns includes the gun 100, collect user input via the user interface, where the user input indicates that the operator is permitted to operate the gun 100, generate a configuration message in response to the user input, where the configuration message includes second enrollment data associated with the operator, and transmit the configuration message to the gun 100. The configuration message may be transmitted to the gun 100 over a wired communication channel or over a wireless communication channel. As an example, the wireless communication interface 150 may receive the configuration message transmitted by the device.

Figure 2:
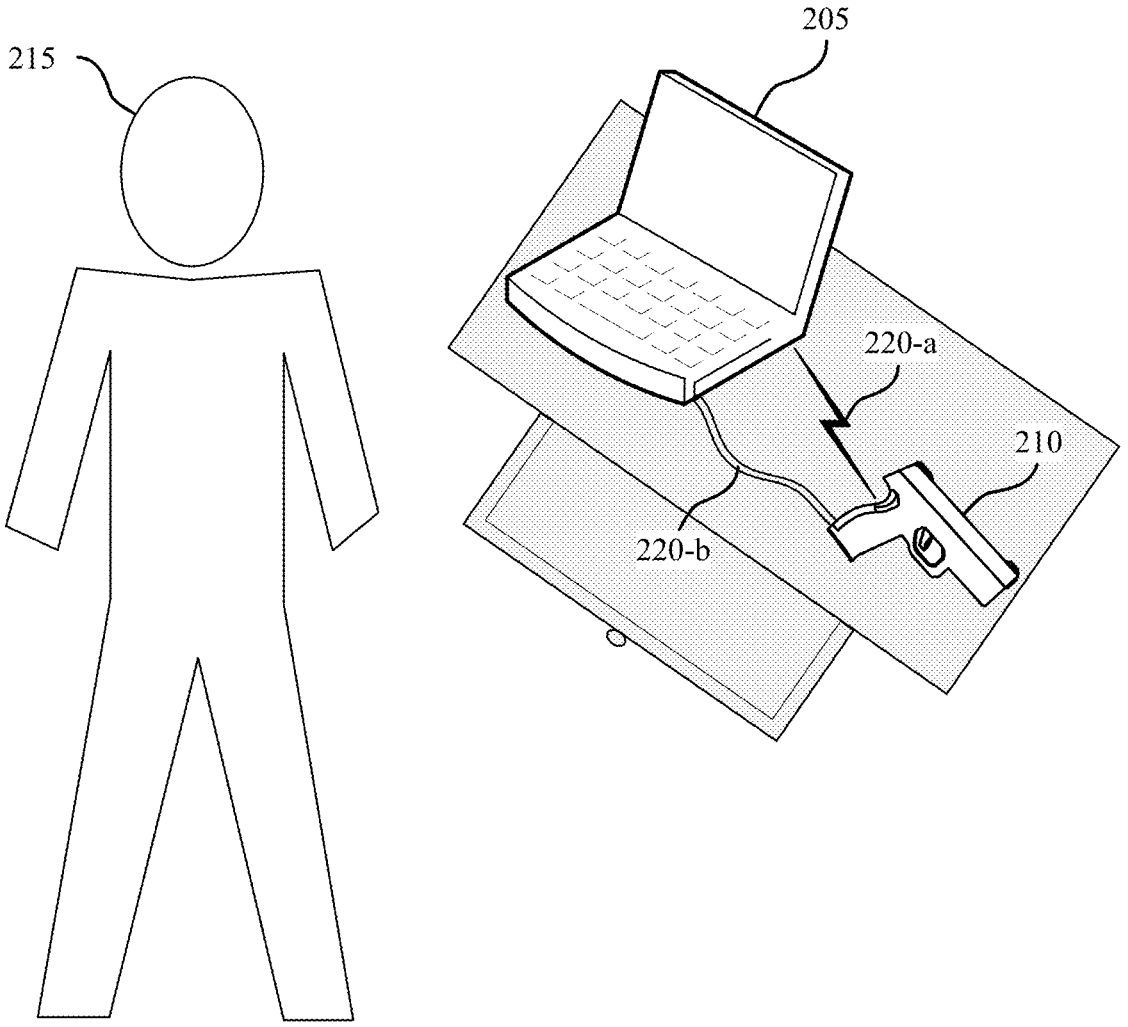
FIG. 2 illustrates an example of a system for managing a user-authenticated gun.

FIG. 2 illustrates an example of a system 200 for managing user-authenticated guns. In some examples, the system 200 may be used by an organization, such as a law enforcement agency, to manage a user-authenticated gun. An example of a user-authenticated gun is a gun that functions for authorized individuals and prevents operation by unauthorized individuals. For example, the user-authentication gun may assume a locked state by default, collect query data from a user holding the gun, match the query data to stored enrollment data, and transition to an unlocked state in response to matching the query data to the enrollment data.

The system 200 includes a device 205 that is capable of configuring the gun 210. The administrator 215 may provide user input to the device 205 to configure aspects of the gun 210, such as who can use it and what form(s) of authentication data is needed to verify the identity of the operator. For example, the administrator 215 may configure the gun 210 such that the gun 210 is locked for a period of time, unlocked for a period of time, or locked by default and capable of being unlocked by one or more individuals. The gun may prevent operation while in the locked state and allow operation while in the unlocked state.

The gun 210 may be configured in response to the administrator 215 undergoing a login procedure. The login procedure may be performed by the device 205 or the gun 210, and the login procedure may generate an output indicating that the administrator 215 is authorized to configure the gun 210. As part of the login procedure, the administrator 215 may provide query to the device 205, and the device 205 may authorize the administrator to configure the gun 210 based on the query data matching stored enrollment data.

The device 205 may connect to the gun 210 via a communication channel, such as the wireless communication channel **220-*a* or the wired communication channel 220-*b***. Examples of a wireless communication channel include a radio frequency region, a licensed radio frequency region, an unlicensed radio frequency region, etc. Examples of a wired communication channel include a conductive wire, a bus, a universal serial bus (USB), a serial peripheral interface (SPI), a universal asynchronous receiver/transmitter (UART), an inter-integrated circuit (I2C), etc.

Figure 3:
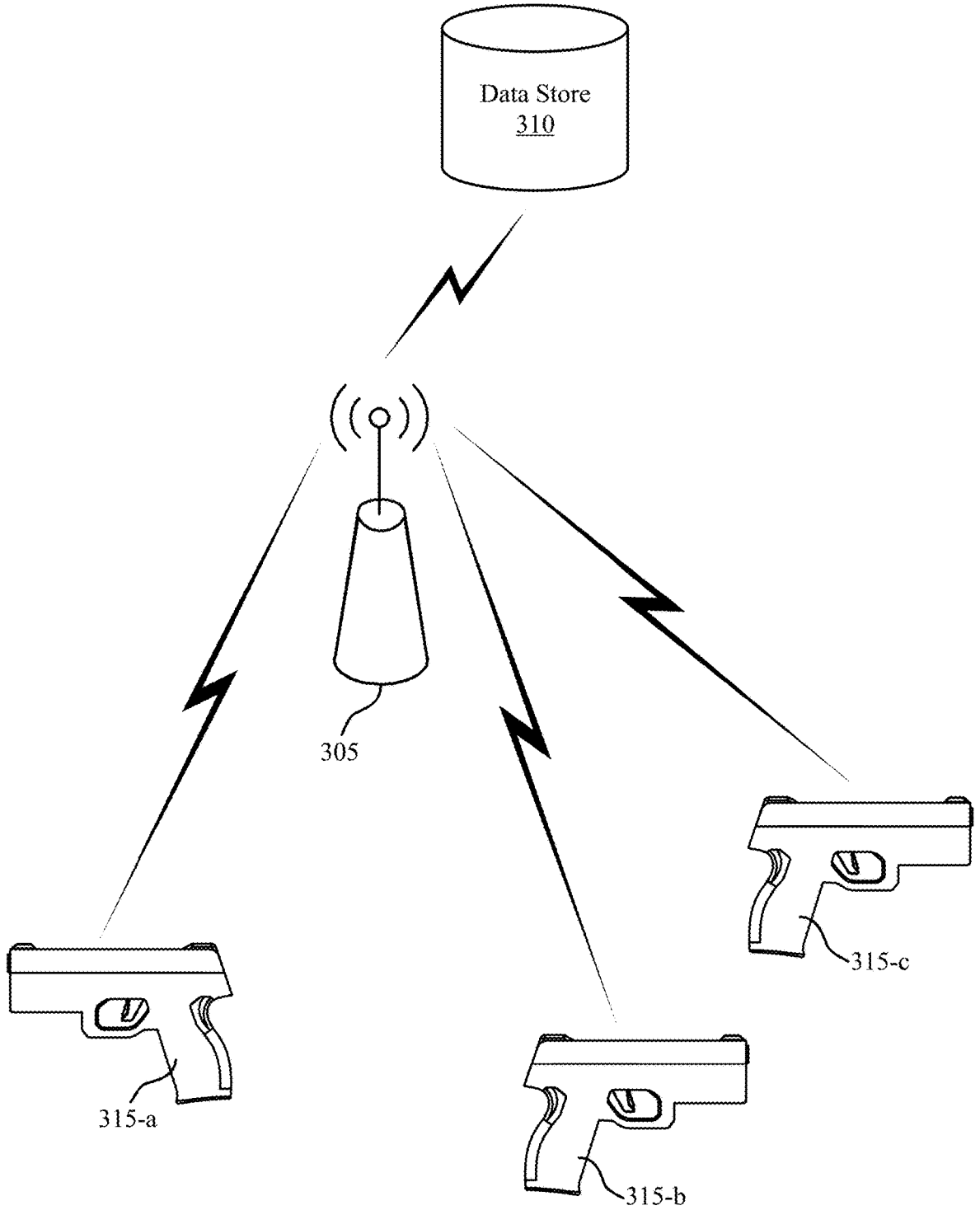
FIG. 3 illustrates an example of a system for managing a fleet of user-authenticated guns.

FIG. 3 illustrates an example of a system 300 for managing a fleet of user-authenticated guns. The system 300 includes a device 305, a data store 310, a gun 315-*a*, a gun 315-*b*, and a gun 315-*c*. The gun 315-*a*, the gun 315-*b*, and the gun 315-*c* are examples of user-authenticated guns. The device 305 may transmit data to, or receive data from, the user-authenticated guns. FIG. 3 illustrates three user-authenticated guns, but it should be understood that the device 305 may be used to manage more or less than three user-authenticated guns.

The device may perform a login procedure to authenticate the identity of the admin, and the device may perform a configuration procedure in response to the login procedure generating an output indicating that the administrator is authorized to configure the user-authenticated guns. As part of the configuration procedure, the administrator may indicate which users are authorized to operate which guns. As part of the configuration procedure, enrollment data may be deployed to the user-authenticated guns from the data store 310. A user-authenticated gun may perform a user authentication procedure to verify the identity of the user, and the user authentication procedure may be defined based on the configuration procedure.

The device 305 may generate a user interface (UI) that is capable of providing information to an administrator and obtaining information from the administrator. For example, the device 305 may visually or audibly provide information to the administrator and collect information from the administrator based on the administrator interacting with the UI (e.g., clicking on a button, adjusting a slider widget, dragging and dropping digital assets, etc.). The device 305 may communicate with the user-authenticated guns via a wireless communication channel. The device 305 may include an antenna that supports the wireless communication with the user-authenticated guns. In some examples, the device 305 may communicate with the user-authenticated guns via a licensed radio-frequency spectrum region, while in some other examples, the device 305 may communicate with the user-authenticated gun via an unlicensed radio-frequency spectrum region. The UI generated by the device 305 may support the login procedure and/or a configuration procedure.

The configuration procedure may be performed in response to a login procedure determining that an administrator is authorized to perform a configuration procedure, and the configuration procedure may be used to configure one or more user-authenticated guns. As an example, the configuration procedure may configure the gun 315-*a* with enrollment data for a first user and the gun 315-*b* with enrollment data for a second user. As such, the gun 315-*a* may be operated by the first user and the gun 315-*b* may be operated by the second user.

As an illustrative example, an administrator may provide query data to the device 305 via the UI, the device 305 may match the query data to enrollment data stored in the data store 310 to verify that the administrator is authorized to perform the configuration procedure. The login procedure may generate an output indicating that the administrator is authorized to perform the configuration procedure, and the device 305 may perform a handshake procedure in response to the output indicating that the administrator is authorized to perform the configuration procedure.

The handshake procedure may generate an output indicating that the gun 315-*c* is a trusted device. In response to the output generated by the login procedure and the output produced by the handshake procedure, the device 305 may generate a configuration message. The configuration message may be further based on user input provided by the administrator, such as user input indicating that a third user is authorized to operate the gun 315-*c*. The device 305 may transmit the configuration message to the gun 315-*c*, and the gun 315-*c* may be modified in response to the configuration message. As an example, the configuration message may include transformed enrollment data for the third user, and the third user may operate the gun 315-*c* based on the configuration message containing the enrollment data being transmitted to the gun 315-*c*. For example, the third user may provide query data to the gun 315-*c* during the course of duty, and the gun 315-*c* may function based on the query data matching the enrollment data stored in memory of the gun.

In some examples, a configuration message may include an indication of a time window and the gun may function based on the time window not being expired. As another example, a configuration message may indicate which type (s) of authentication are expected during a user authentication procedure. For example, the administrator may configure the gun 315-*c* to unlock in response to a user providing a valid fingerprint or a valid iris. As another example, the administrator may configure the gun 315-*c* to unlock in response to a user providing valid biometric data (e.g., fingerprint data, iris data, facial data, etc.) and valid token data (e.g., a Bluetooth token, a personal identification number (PIN), an RFID tag, etc.). As yet another example, the administrator may configure the gun 315-*c* to unlock in response to a user providing valid authentication data while the gun 315-*c* is in a predetermined location (e.g., a geographic area defined by global positioning system (GPS) coordinates).

The data store 310 may store enrollment data, and the enrollment data may be collected by the device 305 or a gun, such as the gun 315-*a*. The enrollment data may be collected as part of a user enrollment procedure. The enrollment data may be transformed according to a data transformation procedure, and the transformed version of the enrollment data may be stored in the data store 310. A configuration message may contain enrollment data (which may be in transformed form), and the configuration message may be transmitted to a gun as part of a configuration procedure.

The gun 315-*a* may include a wireless communication chip that facilitates wireless communication with the device 305. The gun 315-*a* may communicate with the device 305 according to a communication protocol. The device 305 may perform a handshake procedure with the gun 315-*a*. In some examples, the device 305 may perform a configuration procedure on the gun 315-*a* in response to the handshake procedure. The handshake procedure may be performed to verify the authenticity of the device 305, to verify the authenticity of the gun 315-*a*, or to determine a cryptographic secret shared between the device 305 and the gun 315-*a*. The authenticity of the device 305 and/or the gun 315-*a* may be verified based on a digital signature, a random challenge, a digital certificate, or the like. The cryptographic secret may be determined based on a Rivest-Shamir-Adleman (RSA) exchange, a Diffie-Hellman (DH) exchange, an Extended Triple Diffie-Hellman (X3DH) exchange, or the like. The cryptographic secret may be used to derive an ephemeral cryptographic key, and the ephemeral cryptographic key may be used for encrypting and decrypting messages that are exchanged between the device 305 and the gun 315-*a*.

The ephemeral cryptographic key may be discarded following a communication session (also referred to simply as a "session"). A session may include one or more messages that have been encrypted using, or are otherwise associated with, a cryptographic secret. The ephemeral cryptographic key may be updated (also referred to as "ratcheted") during a communication session. A cryptographic key, such as an ephemeral cryptographic key, may be ratcheted according to a key derivation function (KDF), a DH-ratchet, or the like. As an example, an ephemeral key may be used to encrypt a message, the ephemeral key may be ratcheted to produce a new ephemeral key, the new ephemeral key may be used to encrypt a new message, and so on. The device 305 includes a wireless communication interface, but it should be understood that the device 305 may include a wireless communication interface, a physical communication interface, or both. An integrated circuit that facilitates electronic communication is an example of a communication interface. Such an integrated circuit may be referred to as a "chip."

Figure 4:
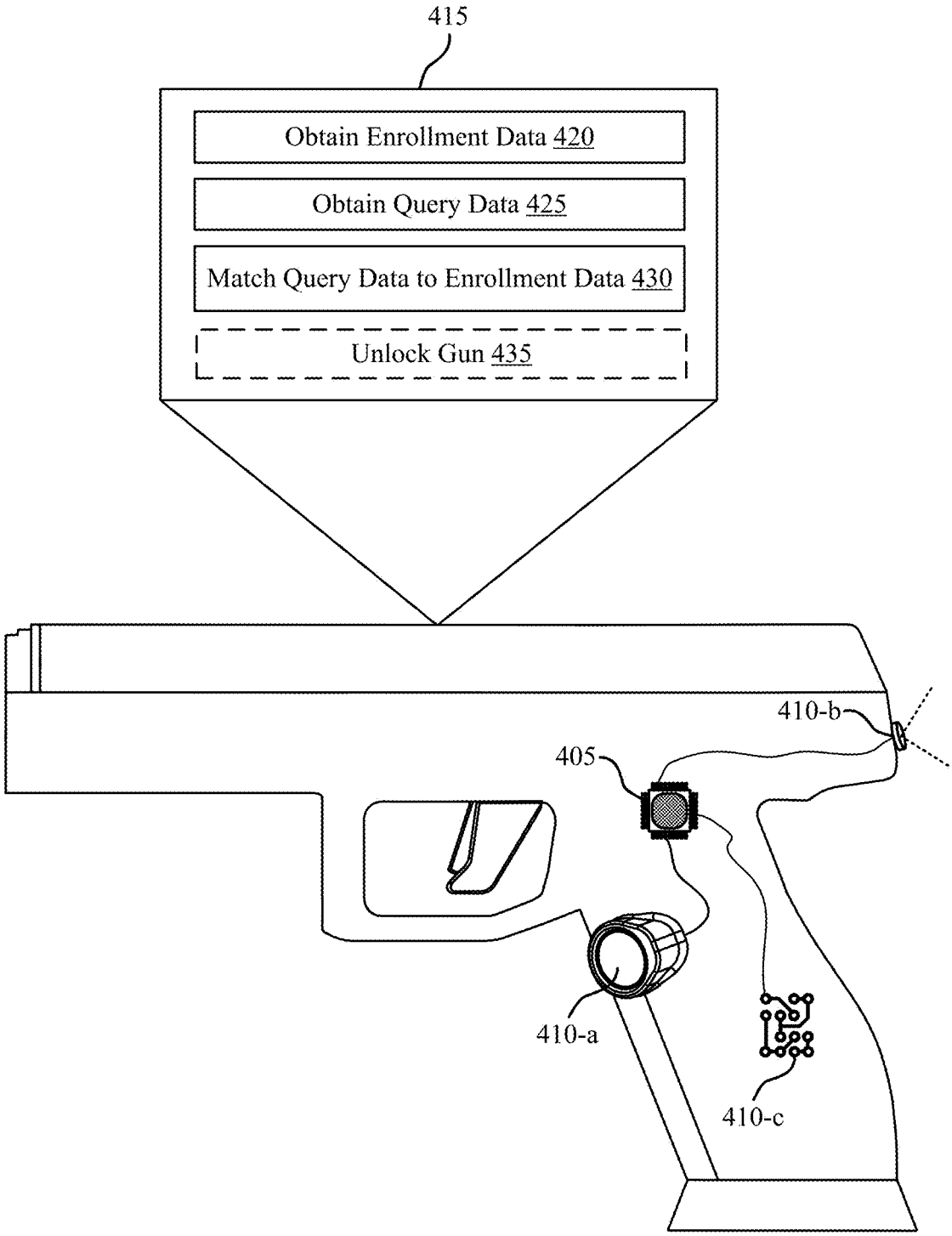
FIG. 4 illustrates an example of a gun that supports a user authentication procedure.

FIG. 4 illustrates an example of a gun 400 that supports a user authentication procedure. The gun 400 includes a processor 405, a fingerprint scanner 410-*a*, a camera 410-*b*, and a wireless communication interface 410-*c*. The fingerprint scanner 410-*a*, the camera 410-*b*, and the wireless communication interface 410-*c* are examples of authentication components that support performing a user authentication procedure.

The gun 400 may perform a user authentication procedure 415 to determine whether a user (e.g., an operator) is authorized to operate the gun 400. The gun 400 may perform the user authentication procedure 415 while the user is holding or in close proximity to the gun 400 (e.g., within a distance threshold, such as 6 inches or 16 feet e.g., within a distance threshold, such as 6 inches or 16 feet).

At step 420, the gun may obtain enrollment data. The enrollment data may be stored locally in memory of the gun 400, or the enrollment data may be stored in a remote data store. The enrollment data may be a transformed version of authentication data collected during a user enrollment procedure. For example, the enrollment data may include a digital signature that was collected and encrypted as part of a user enrollment procedure. As another example, the enrollment data may include biometric data that was collected and transformed according to a one-way (e.g., non-invertible) function as part of a user enrollment procedure.

At step 425, the gun may obtain query data. The query data may include biometric data and/or token data. For example, the fingerprint scanner 410-*a* may collect fingerprint data, the camera 410-*b* may collect facial or iris data, and the wireless communication interface 410-*c* may collect token data.

At step 430, the gun 400 may performing a matching procedure to determine whether the enrollment data matches the query data. In some examples, the gun 400 may perform the matching procedure based on a configuration procedure. For example, the configuration procedure may configure the gun 400 to authorize a user to operate the gun 400 based on a biometric data match and a token data match, and the gun may be unlocked at step 435 in response to authorizing the user to operate the gun 400. Continuing with the example, the gun 400 may authorize the user to operate the gun 400 based on determining that query facial data collected by the camera 410-*b* matches enrollment facial data and determining that query RFID data collected by the wireless communication interface 410-*c* matches enrollment RFID data, and the gun 400 may be unlocked (e.g., transition to a state that allows the gun 400 to fire projectiles, remove an electromechanical safety, etc.) in response to authorizing the user to operate the gun 400. The gun may identify a data match based on a similarity threshold being satisfied. For example, the gun may identify a facial data match based on enrollment facial data and query facial data satisfying a similarity score of 0.95, 99, 0.999, 0.9999, etc. As another example, the gun may identify an RFID data match based on enrollment RFID data and query RFID data satisfying a similarity score of 1.

As an illustrative example, a law enforcement official may carry a passive RFID tag within a badge, within a uniform, implanted under skin, or in a duty belt, and the gun 400 may initiate the user authentication procedure 415 in response a user presence sensor indicating that the gun 400 is being held. As part of the user authentication procedure 415, the fingerprint scanner 410-*a* may attempt to collect fingerprint data, the camera 410-*b* may attempt to collect facial data, and the wireless communication interface 410-*c* may attempt to collet token data from the passive RFID tag. In response to matching enrollment biometric data to query biometric data collected by the fingerprint scanner 410-*a* or the camera 410-*b* and matching enrollment token data to query token data collected by the wireless communication interface 410-*c*, the gun 400 may be unlocked. The gun 400 may maintain the unlocked state as long as the gun 400 is being gripped by a hand, and the gun 400 may transition to an unlocked state when the gun 400 is released, holstered, or dropped.

Figure 5:
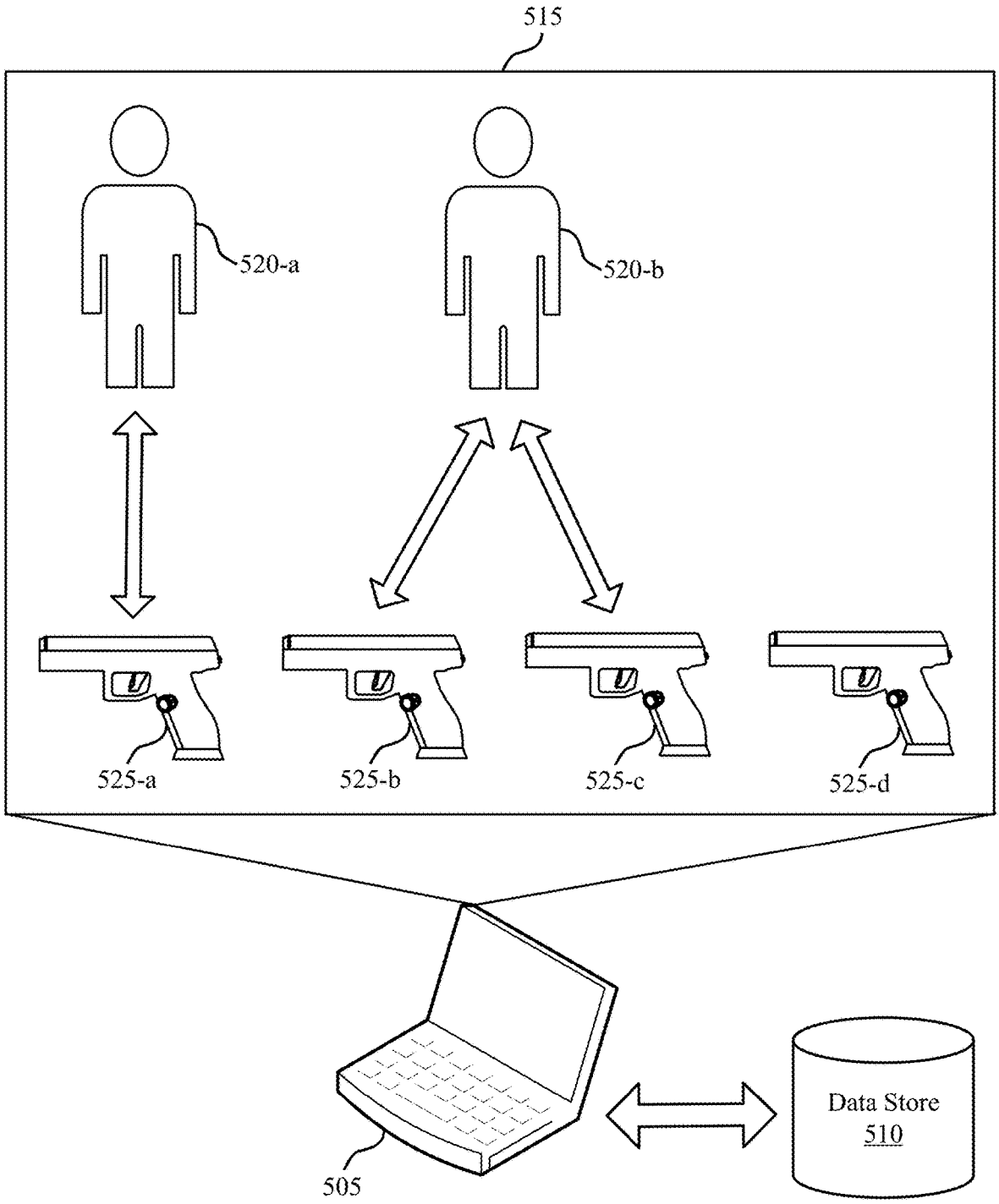
FIG. 5 illustrates examples of a user interface that supports configuring a gun.

FIG. 5 illustrates an example of a UI 515 generated by a device 505. The device 505 may be a computer, a laptop, a desktop, a smartphone, or another processing system capable of generating a UI that supports performing a configuration procedure. The UI 515 is an illustrative example of a UI, but it should be understood that various different types of UIs may be used as part of a configuration procedure.

The device 505 may be coupled with the data store 510 via a wired connection or via a wireless connection. The data store 510 may store authentication data obtained as part of a user enrollment procedure. The authentication data stored in the data store 510 may be referred to as "enrollment data." The enrollment data may be transformed into a transformed version of the enrollment data and the transformed version of the enrollment data may be stored in the data store 510. The data store may refrain from storing the original (e.g., non-transformed) version of the enrollment data. Storing enrollment data in transformed form preserves user privacy and improves data security.

As administrator may provide user input to the UI 515 as part of a configuration procedure to configure one or more user-authenticated guns. For example, the administrator may use the UI 515 to grant permission to the user 520-*a* to use the gun 525-*a* and to grant permission to the user 520-*b* to use the gun 525-*b* and the gun 525-*c*. In response to the user input indicating that the user 520-*a* is permitted to operate the gun 525-*a* and that the user 520-*b* is permitted to operate the gun 525-*b* and the gun 525-*c*, enrollment data for the user 520-*a* may be transmitted from the data store 510 to the gun 525-*a* and enrollment data for the user 520-*b* may be transmitted form the data store 510 to both the gun 525-*b* and the gun 525-*c*. The guns illustrated in the UI 515 are examples of assets representing real guns, and the users illustrated in the UI 515 are examples of assets representing real operators.

The UI 515 shows no user being permitted to operate the gun 525-*d*. In such a scenario, the gun 525-*d* may not operate for any user, meaning the gun 525-*d* will maintain a locked state. As such, the device 505 may verify that the gun 525-*d* does not contain enrollment data for any users, or the device 505 may transmit a configuration message to the gun 525-*d* indicating that no users are permitted to operate the gun 525-*d*.

Figure 6:
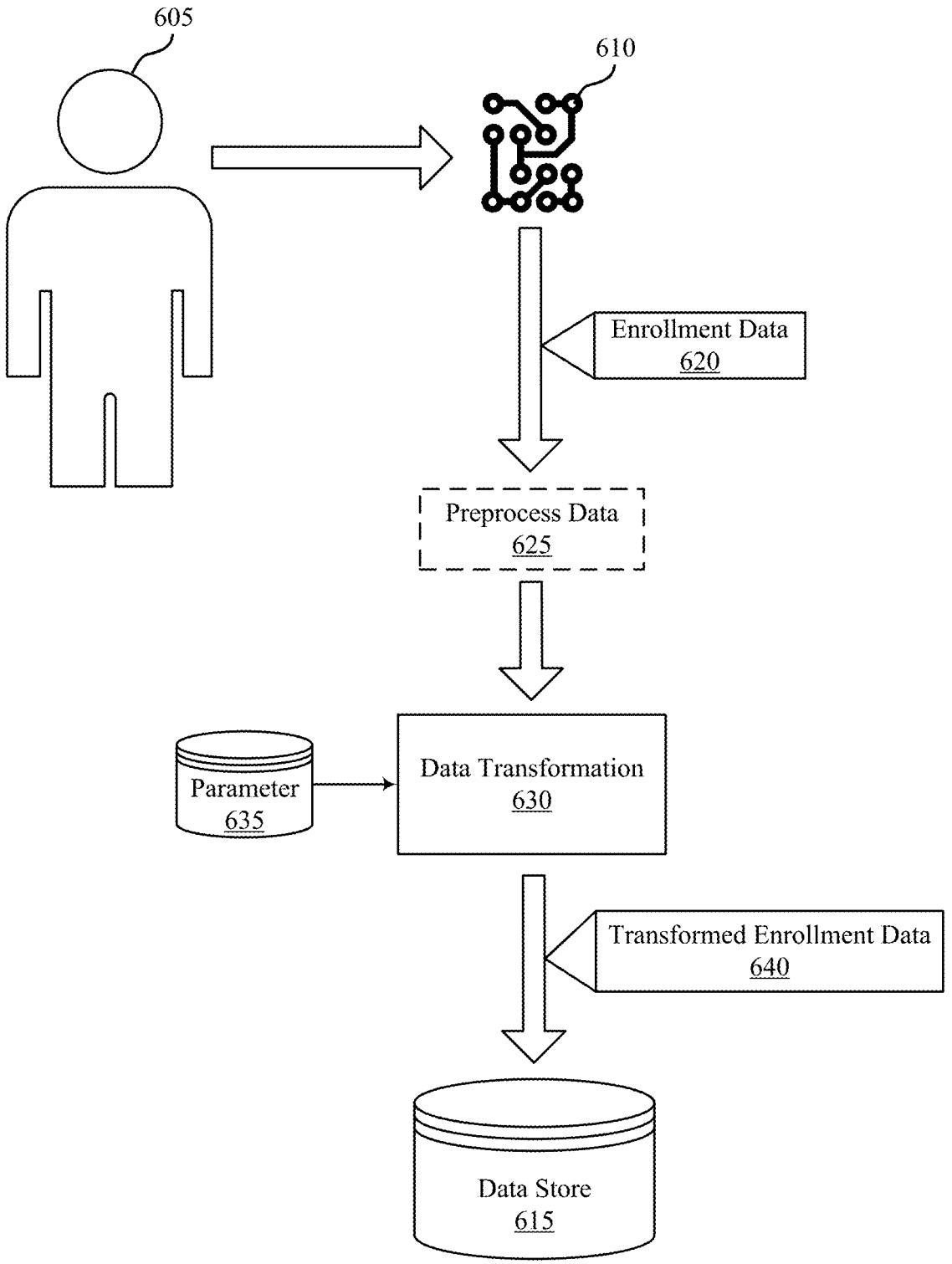
FIG. 6 illustrates an example of a user enrollment procedure.

FIG. 6 illustrates an example of a user enrollment procedure 600. The data collection component 610 supports collecting authentication data. Examples of data collection components include biometric sensors, wireless communication interfaces, antennas, and integrated circuits. The data collection component 610 may be an aspect of a gun or a device (e.g., a computer, a smartphone, a docking station, an enrollment station, etc.) that supports collecting authentication data.

The data collection component 610 may collect the enrollment data 620 (e.g., authentication data) from the human user 605 (e.g., an operator, a law enforcement individual, etc.), and the enrollment data 620 may be stored in the data store 615. In some examples, the enrollment data 620 may include non-biometric authentication data, while in some additional or alternative examples, the enrollment data 620 may include biometric authentication data. The enrollment data 620 may be transformed before being stored in the data store 615, and the transformed version of the enrollment data 620 may be stored in the data store 615.

At step 625, the enrollment data 620 may be preprocessed. As an example, the enrollment data 620 may include non-biometric enrollment data (e.g., RFID data, Bluetooth data, NFC data, etc.), and the data collection component 610 may apply error correcting codes to the enrollment data 620 at step 625. As another example, the enrollment data 620 may include biometric enrollment data (e.g., fingerprint data, facial data, vein pattern data, iris data, electrocardiogram (EKG) data, etc.), and the data collection component 610 may perform binarization, segmentation, or feature extraction on the enrollment data 620 at step 625. Preprocessing the enrollment data 620 may improve the quality of the data. As an illustrative example, the enrollment data 620 may include fingerprint data, and the preprocessing of the fingerprint data may include binarizing (e.g., thresholding) the fingerprint data and extracting a set of features (e.g., minutiae data) from the binarized fingerprint data. As another example, the enrollment data 620 may include facial data, and the preprocessing of the facial data may include detecting a face and segmenting the face. In some examples, preprocessing the enrollment data 620 may include extracting a set of features, and the set of features may be extracted according to local binary patterns, Fisher vectors, a principal component analysis, a Histogram of Gradient, Bag of Words, or the like. For example, the set of features may be extracted from the enrollment data 620 by performing Fisher discriminant analysis on the enrollment data 620.

The enrollment data 620 may be transformed (e.g., hashed, encrypted, encoded, etc.) at step 630 to produce the transformed enrollment data 640, and the transformed enrollment data 640 may be stored in the data store 615, thereby improving data security and user privacy. The enrollment data 620 may be transformed based on a parameter 635, such as a transformation key (or simply "key"). A key may be an example of a cryptographic key, a projection matrix, or a coordinate shifting key. As an example, non-biometric data may be transformed according to an encryption procedure (e.g., a symmetric encryption procedure or an asymmetric encryption procedure) that uses a cryptographic key, and biometric data may be transformed according to a one-way function that uses a projection matrix. The enrollment data 620 may be transformed according to a hashing scheme (e.g., Biohash, Palmhash, etc.), an encryption scheme, a cancellable biometric scheme, a biometric cryptosystem, or hybrid a scheme (e.g., a combination of a hashing scheme and a biometric cryptosystem).

Figure 7:
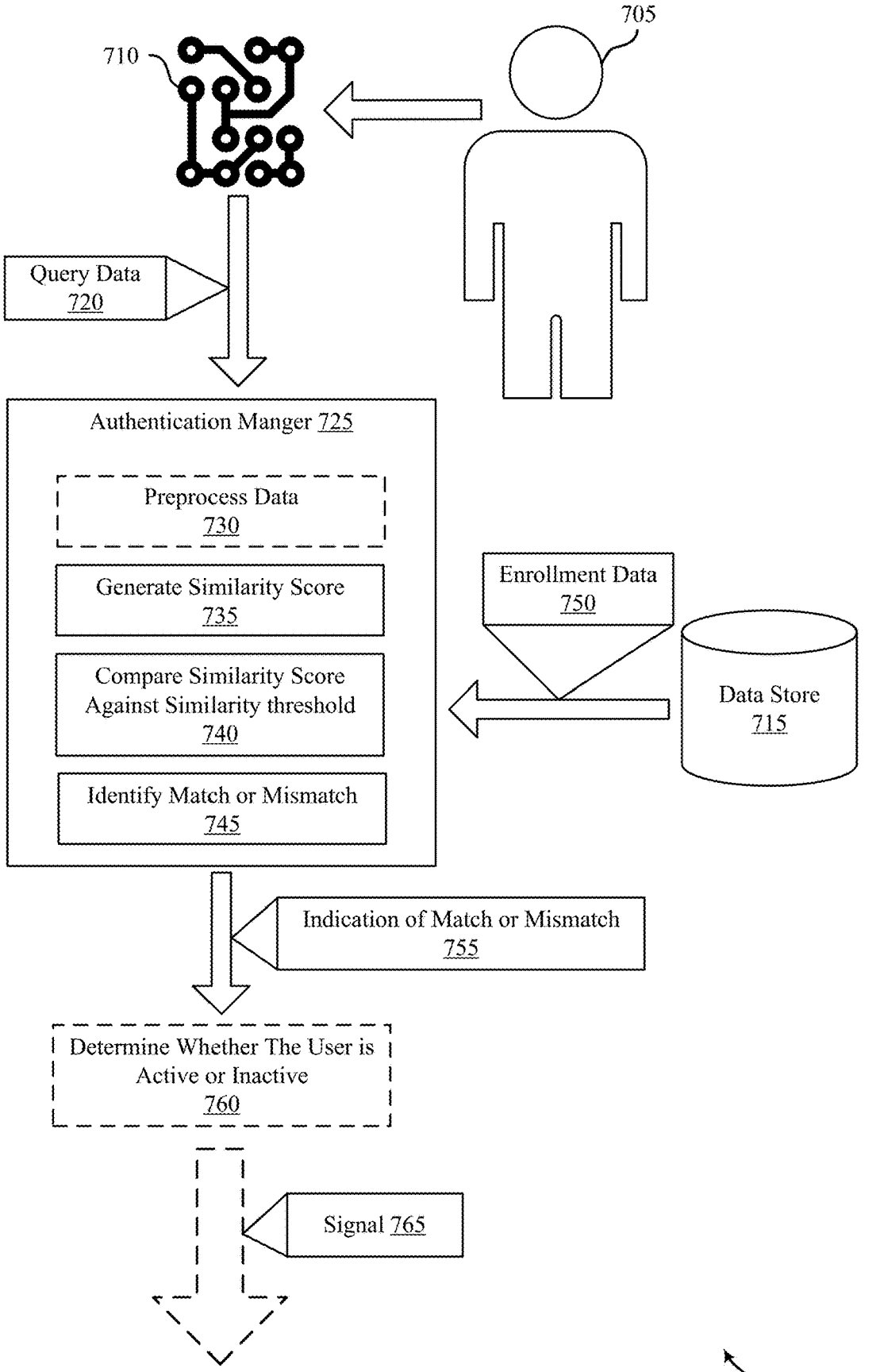
FIG. 7 illustrates an example of a user authentication procedure.

FIG. 7 illustrates an example of a user authentication procedure 700. The data collection component 710 supports collecting authentication data. Examples of data collection components 710 include biometric sensors, wireless communication interfaces, antennas, and integrated circuits. The data collection component 710 may be an aspect of a gun or a device (e.g., a computer, a smartphone, a docking station, an enrollment station, etc.) that supports collecting authentication data.

The data collection component 710 may support collecting biometric data and/or non-biometric data, such as token data. As an example, the data collection component 710 may be a biometric sensor (e.g., a fingerprint sensor, a camera, an image sensor, an ultrasonic sensor, optical sensor, a capacitive sensor, an impedance sensor, etc.) or a token sensor (e.g., an RFID reader, an NFC reader, a Bluetooth reader, a wireless communication chip, an antenna, an antenna array, etc.). A token sensor may also be referred to as a non-biometric sensor.

The authentication manager 725 may be an example of, or include components of, a general-purpose processor, an application-specific integrated circuit (ASIC), a hardware security module (HSM), a microcontroller, or the like. The authentication manager 725 may be an aspect of a gun, such as a user-authenticated gun. The data collection component 710 may obtain the query data 720 from the human user 705. The human user 705 may also be referred to as an "operator." The authentication manager 725 may obtain the query data 720 from the data collection component 710 and the enrollment data 750 from the data store 715. FIG. 7 illustrates the authentication manager 725 performing various steps as part of a user authentication procedure, but it should be understood that the steps may be performed in a different order, additional steps may be added, or some steps may not be performed.

The query data 720 may include biometric data and/or non-biometric data. For example, the query data 720 may include fingerprint data, facial data, vein pattern data, iris data, impedance data, heart rate data, blood pressure data, EKG data, or grip pressure data, received from an image sensor, such as a fingerprint scanner or a camera. In some examples, the query data 720 may be preprocessed at step 730. Preprocessing the query data 720 may include grayscale transformation, normalization, segmentation, edge detection, orientation prediction, binarization, thinning, feature extraction, or any combination thereof. Preprocessing the query data 720 may improve the accuracy of the authentication procedure by reducing the noisiness of the data.

The authentication manager 725 may extract a set of features based on the query data 720, and the authentication manager 725 may determine the types of features to extract based on the type of the query data 720. For example, the query data 720 may be received from a fingerprint scanner and the authentication manager 725 may extract features based on ridge characteristics (also referred to as "minutiae"). In another example, the query data 720 may be received from a facial recognition camera and the authentication manager 725 may extract features based on facial characteristics, image texture, or Fisher vectors. In some examples, the features extracted from the query data 720 may be structured (e.g., such as when the features are based on minutiae or facial characteristics), while in other examples, the features extracted from the query data 720 may be unstructured (e.g., such as when the features are based on image texture or Fisher vectors).

As an illustrative example, the extracted features may include ridge characteristics (e.g., ridge endings, ridge bifurcations, ridge islands, ridge lakes, etc.), scars, pores, local binary patterns, histogram of gradients, speeder robust features, facial characteristics (e.g., mouth geometry, nose geometry, etc.), Fisher vectors, eigenvectors, image texture, features produced by Gabor wavelets, or the like. As another example, an artificial neural network (e.g., based on a convolutional neural network (CNN) or recurrent neural network (RNN)) may extract features as part of a training procedure, and the features may be encoded in the artificial neural network as node weights. As another example, the query data 720 may be filtered as part of the preprocessing at step 730 to produce features. For example, Gabor filters (e.g., two dimensional Gabor filters, Ateb-Gabor filters, etc.) may be applied to the query data 720 to produce the set of features.

At step 735, the authentication manager 725 may generate a similarity score indicating the similarity of the query data 720 and the enrollment data 750. The query data 720 may include a set of query features and the enrollment data 750 may include a set of enrollment features. The similarity score may be a normalized value between zero and one, where zero indicates the query data 720 and enrollment data 750 are dissimilar, and where one indicates that the query data 720 and the enrollment data 750 are similar. As an example, a distance (e.g., Euclidean distance, Manhattan distance, Mahalanobis distance, etc.) may be calculated between the query data 720 and the enrollment data 750, and the similarity score may be expressed by 1−distance. As another example, the similarity score may be generated by calculating the cosine similarity, the Dice similarity, the Jaccard similarity, or MinHash similarity of the query data 720 and the enrollment data 750. In some examples, a local similarity score may be calculated for each feature vector in the query data 720. In such examples, the similarity score indicting the similarity of the query data 720 and the enrollment data 750 may be referred to as a global similarity score, and the global similarity score be expressed as the average local similarity score, the median local similarity score, or $$\frac{2*m}{(q+e)},$$

where "m" is the number of feature matches, "q" is the number of query features in the query data, and "e" is the number of enrollment features in the enrollment data. As another example, the global similarity score may be expressed by $$\frac{2*m}{(qo+eo)}$$

where "m" is the number of feature matches, "qo" is the number of query features in the query data that are also present in the enrollment data, and "e" is the number of enrollment features in the enrollment data that are also present in the query data. As an illustrative example, a feature may be considered present in both the query data 720 and the enrollment data 750 based on the local similarity score for the feature being greater than a dynamic local similarity threshold, such as the average similarity score of the features present in the query data, or based on the local similarity score for the feature being greater than a predetermined local similarity threshold, such as 0.75, 0.8, 0.85, 0.9, 0.95, 0.98, 0.99, 0.995, 0.999, or 0.9999.

As another example, an artificial neural network may be used to generate a similarity score. The artificial neural network used to generate the similarity score may be an example of a regression model, a classification model, or a ranking model. An example of a ranking model is a Siamese model. The artificial neural network that generates the similarity score may be referred to as a similarity model. The similarity model may undergo a training procedure, where training data is fed into the similarity model, the model generates an output, and the weights of the model are updated based on the output. The weights of the model may be updated based on a backpropagation procedure that aids in calculating the gradient of the loss function with respect to the loss, and the weights may be adjusted according to a step size such that the loss is reduced. As an illustrative example, a feature extraction model (e.g., a CNN) may be used to extract query features from the query data 720 and the similarity model may (e.g., a Siamese model) may produce a similarity score for the query features with respect to the enrollment features from the enrollment data 750. In other words, a similarity model may take two sets of features as input and produce a similarity score as output. The input may include features extracted from the query data 720 and features extracted from the enrollment data 750, and the output may correspond to a similarity score indicating the similarity of the two input feature sets or a distance between the two input feature sets.

At step 740, the authentication manager 725 may compare the similarity score against a similarity threshold. The authentication manager 725 may identify a match at step 745 based on the similarity score being greater than or equation to the similarity threshold, and the authentication manager 725 may identify a mismatch based on the similarity score being less than the similarity threshold. As an example, the authentication manager 725 may identify a match based on the similarity score satisfying a similarity threshold (e.g., the similarity score being greater than or equal to a similarity score of 0.97, 0.98, 0.99, 0.995, or 0.999), and the authentication manager 725 may identify a mismatch based on the similarity score satisfying a dissimilarity threshold (e.g., the similarity score being less than a similarity score of 0.97, 0.98, 0.99, 0.995, or 0.999).

At step 755, the authentication manager 725 may generate an indication of a match (e.g., a successful match) or an indication of a mismatch (e.g., an unsuccessful match). A match may represent the similarity score for the query data 720 and the enrollment data 750 satisfying the similarity threshold (e.g., such as when the query data 720 is collected from a user that has been enrolled to operate the gun containing the authentication manager 725), and a mismatch may represent the similarity score for the query data 720 and the enrollment data 750 not satisfying the similarity threshold (e.g., such as when the query data 720 is collected from a user that has not been enrolled to operate the gun containing the authentication manager 725).

In some examples, the authentication manager 725 may determine whether the user is an active user or an inactive user at step 760. The authentication manager 725 may perform step 760 based on identifying a match at step 745 and/or generating an indication of the match at step 755. In some examples, a primary user (e.g., an administrator, an owner, etc.) of the gun may allow a secondary user (e.g., an operator, an authorized user, a temporary user, etc.) to be enrolled on the gun, and the primary user may control whether the secondary user is active or inactive. For example, the primary user may configure the gun such that the user is authorized to operate the gun. As another example, the primary user may configure the gun such that the secondary user is a temporary user who is authorized to operate the gun for a duration of time (e.g., an hour, a day, a week, etc.). In other words, the primary user may configure the gun to allow an authorized user to operate the gun in response to the authorized user providing authentication data (e.g., fingerprint data, facial data, iris data, a Bluetooth token, an NFC token, etc.) to the gun, and the primary user may configure the gun to allow a temporary user to operate the gun in response to the temporary user providing authentication data within the duration of time. The gun may not allow the temporary user to operate the gun outside of the duration of time. For example, the primary user may configure the gun with a temporary user that is authorized to operate the gun for an hour, and the gun may allow the temporary user to operate the gun within the hour timeframe and not allow the temporary user to operate the gun outside of the hour timeframe. Allowing the creation of secondary users improves gun safety and user experience, as a primary user may configure the gun to allow a secondary user, such as a friend or a child, to operate the gun for a duration of time and automatically prevent the secondary user from operating the gun after the duration of time. Additionally, the primary user may use a display panel to toggle the secondary user as active as inactive without the secondary user having to re-enroll biometric data at the gun.

A primary user may configure the gun by providing input to the gun via a display panel of the gun, a display panel of a docking station (also referred to as a "dock") or an application, such as a web application, a desktop application, or a mobile application. The primary user may provide user input, such as a selection of a "Create new user" button on the display panel, to generate a secondary user. As part of configuring the gun to authorize a secondary user to operate the gun, the primary user may perform an authentication procedure. In response to successfully authenticating the primary user, the gun may generate a prompt for authentication data from the secondary user. The prompt may be a prompt for biometric data, token data, or both. For example, the display panel may show a text message prompting the secondary user to place a finger on a fingerprint scanner, enter the field of view of a camera, move an RFID tag close to the gun, select an option within an associated mobile application, or the like. In response to receiving the authentication data, the gun may create a user account for the secondary user and store the authentication data (e.g., enrollment data, such as transformed biometric data or encrypted token data) in memory of the gun. As part of a user authentication procedure, the gun may receive query data from the secondary user, identify a data match based on the received query data matching stored enrollment data, identify an active status of the secondary user, and transition to an active state (e.g., an unlocked state) in response to identifying the data match and identifying the active status of the secondary user. The active status of the secondary user may be identified based on a data flag, such as a Boolean value stored in memory, indicating an active status for the secondary user.

The authentication manager 725 may transit a signal 765 based on identifying a match at step 745, based on generating an indication of the match at step 755, based on determining that the user is an active user at step 760, or any combination thereof. As an example, the authentication manager 725 may transmit the signal 765 in response to identifying a match at step 745. As another example, the authentication manager 725 may transmit the signal 765 in response to identifying a match at step 745 and determining that the user is an active user at step 760.

Figure 8:
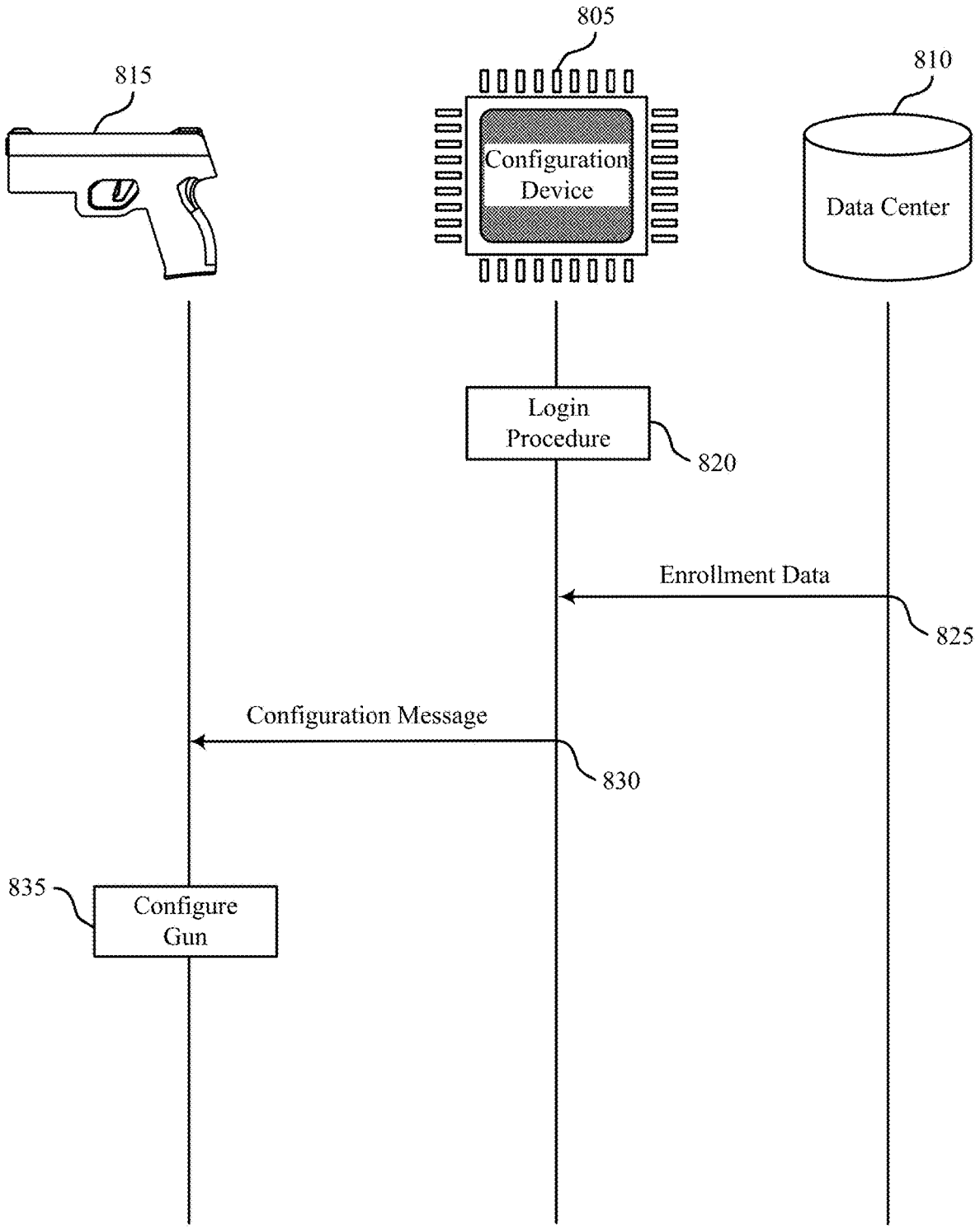
FIG. 8 illustrates an example of a process flow that supports managing a user-authenticated gun.

FIG. 8 illustrates an example of a process flow 800 that supports managing a user-authenticated gun. The process flow 800 includes a configuration device 805, a data center 810, and a gun 815, which may be examples of the corresponding components described herein. The configuration device 805 may be operated by an administrator to configure aspects of the gun 815. The data center 810 may store authentication data, such as authentication data collected during a user enrollment procedure (which may be referred to as "enrollment data"). Alternative examples of the following may be implemented, where some steps are performed in a different order than described or are not performed at all. In some cases, steps may include additional features not mentioned below, or further steps may be added.

At step 820, the administrator may login to the configuration device. The administrator may provide authentication data (e.g., a password, biometric data, two-factor authentication, etc.) to prove that the administrator is authorized to operate the configuration device 805.

At step 825, the configuration device 805 may receive enrollment data from the data center 810. In some examples, the enrollment data may be transmitted directly from the data center 810 to the gun 815, while in some other examples, the enrollment data may be transmitted from the data center 810 to the configuration device 805 and the configuration device 805 may transmit the enrollment data to the gun 815.

At step 830, the configuration device 805 may transmit a configuration message to the gun 815. The configuration message may include enrollment data and/or instructions indicating how to perform a user authentication procedure. For example, the configuration message may indicate that user authentication procedures should authenticate operators in response to matching two pieces of query data to enrollment data. As another example, the configuration message may indicate that user authentication procedures should authenticate operators in response to matching both a piece of biometric query data (e.g., fingerprint data, iris data, facial data, vein pattern data, etc.) to enrollment data and a piece of non-biometric query data (e.g., RFID data, Bluetooth data, NFC data, etc.) to enrollment data.

At step 835, aspects of the gun 815 may be configured in response to the configuration message. As an example, the type(s) of query data used in a user authentication procedure to determine whether an operator is authorized the gun 815 may be defined in response to the configuration message. As another example, the gun 815 may be configured to assume locked state for a duration of time in response to the configuration message. As yes another example, the gun 815 may be configured to assume an unlocked state for a duration of time in response to the configuration message.

Figure 9:
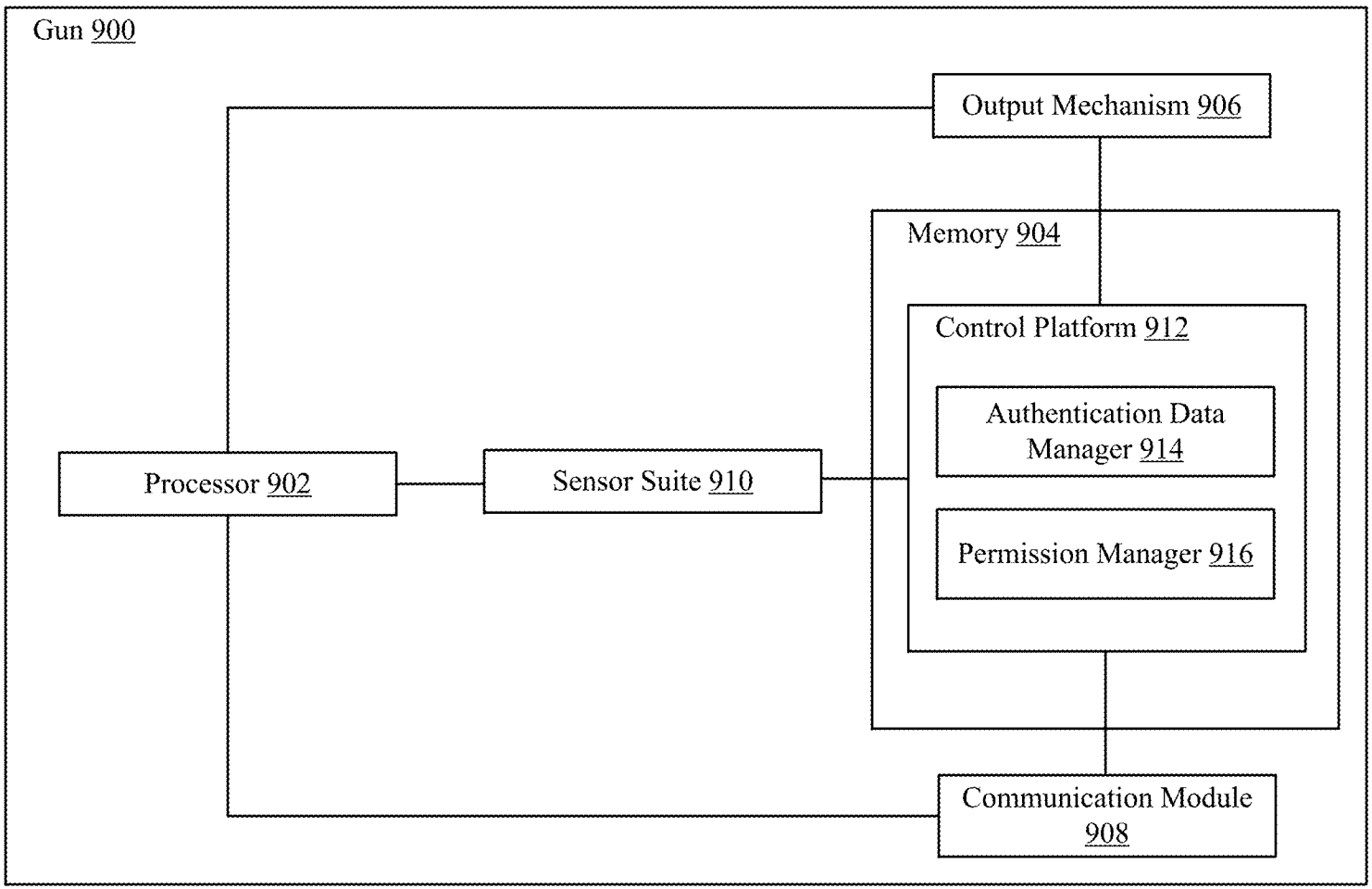
FIG. 9 illustrates an example of a gun able to implement a control platform.

FIG. 9 illustrates an example of a gun 900 able to implement a control platform 912 designed to produce outputs that are helpful in ensuring the gun 900 is used in an appropriate manner. As further discussed below, the control platform 912 (also referred to as a "management platform" or a "configuration manager") may be designed to manage aspects of one or more user-authenticated guns.

In some embodiments, the control platform 912 is embodied as a computer program that is executed by the gun 900. In other embodiments, the control platform 912 is embodied as an electrical circuit that performs logical operations of the gun 900. In yet other embodiments, the control platform 912 is embodied as a computer program that is executed by a computing device to which the gun 900 is communicatively connected. In such embodiments, the gun 900 may transmit relevant information to the computing device for processing as further discussed below. Those skilled in the art will recognize that aspects of the computer program could also be distributed amongst the gun 900 and computing device.

The gun 900 can include a processor 902, memory 904, output mechanism 906, and communication manager 908. The processor 902 can have generic characteristics similar to general-purpose processors, or the processor 902 may be an ASIC that provides control functions to the gun 900. As shown in FIG. 9, the processor 902 can be coupled with all components of the gun 900, either directly or indirectly, for communication purposes.

The memory 904 may be comprised of any suitable type of storage medium, such as static random-access memory (SRAM), dynamic random-access memory (DRAM), electrically erasable programmable read-only memory (EEPROM), flash memory, or registers. In addition to storing instructions that can be executed by the processor 902, the memory 904 can also store data generated by the processor 902 (e.g., when executing the managers of the control platform 912). Note that the memory 904 is merely an abstract representation of a storage environment. The memory 904 could be comprised of actual memory chips or managers.

The output mechanism 906 can be any component that is capable of conveying information to a user of the gun 900. For example, the output mechanism 906 may be a display panel (or simply "display") that includes LEDs, organic LEDs, liquid crystal elements, or electrophoretic elements. Alternatively, the display may simply be a series of illuminants (e.g., LEDs) that are able to indicate the status of the gun 900. Thus, the display may indicate whether the gun 900 is presently in a locked state, unlocked state, etc. As another example, the output mechanism 906 may be a loudspeaker (or simply "speaker") that is able to audibly convey information to the user.

The communication manager 908 may be responsible for managing communications between the components of the gun 900. Additionally or alternatively, the communication manager 908 may be responsible for managing communications with computing devices that are external to the gun 900. Examples of computing devices include mobile phones, tablet computers, wearable electronic devices (e.g., fitness trackers), and network-accessible server systems comprised of computer servers. Accordingly, the communication manager 908 may be wireless communication circuitry that is able to establish communication channels with computing devices. Examples of wireless communication circuitry include integrated circuits (also referred to as "chips") configured for Bluetooth, Wi-Fi®, NFC, and the like.

Sensors are normally implemented in the gun 900. Collectively, these sensors may be referred to as the "sensor suite" 910 of the gun 900. For example, the gun 900 may include a motion sensor whose output is indicative of motion of the gun 900 as a whole. Examples of motion sensors include multi-axis accelerometers and gyroscopes. As another example, the gun 900 may include a proximity sensor whose output is indicative of proximity of the gun 900 to a nearest obstruction within the field of view of the proximity sensor. A proximity sensor may include, for example, an emitter that is able to emit infrared (IR) light and a detector that is able to detect reflected IR light that is returned toward the proximity sensor. These types of proximity sensors are sometimes called laser imaging, detection, and ranging (LiDAR) scanners. As another example, the gun 900 may include a fingerprint sensor or camera that generates images which can be used for, for example, biometric authentication. As shown in FIG. 9, outputs produced by the sensor suite 910 may be provided to the control platform 912 for examination or analysis.

For convenience, the control platform 912 may be referred to as a computer program that resides in the memory 904. However, the control platform 912 could be comprised of software, firmware, or hardware components that are implemented in, or accessible to, the gun 900. In accordance with embodiments described herein, the control platform 912 may an authentication data manager 914 and a permission manager 916. As an illustrative example, the authentication data manager 914 may process data generated by, and obtained from, a fingerprint scanner, and the permission manager 916 may process data obtained from a database. Because the data obtained by these managers may have different formats, structures, and content, the instructions executed by these managers can (and often will) be different. For example, the instructions executed by the authentication data manager 914 to process data generated by a fingerprint scanner may be different than the instructions generated by the permission manager 916 to process data generated by a database. As a specific example, the authentication data manager 914 may implement image processing algorithms (e.g., for denoising, despeckling, etc.) that are not necessary for processing data generated by a database.

Figure 10:
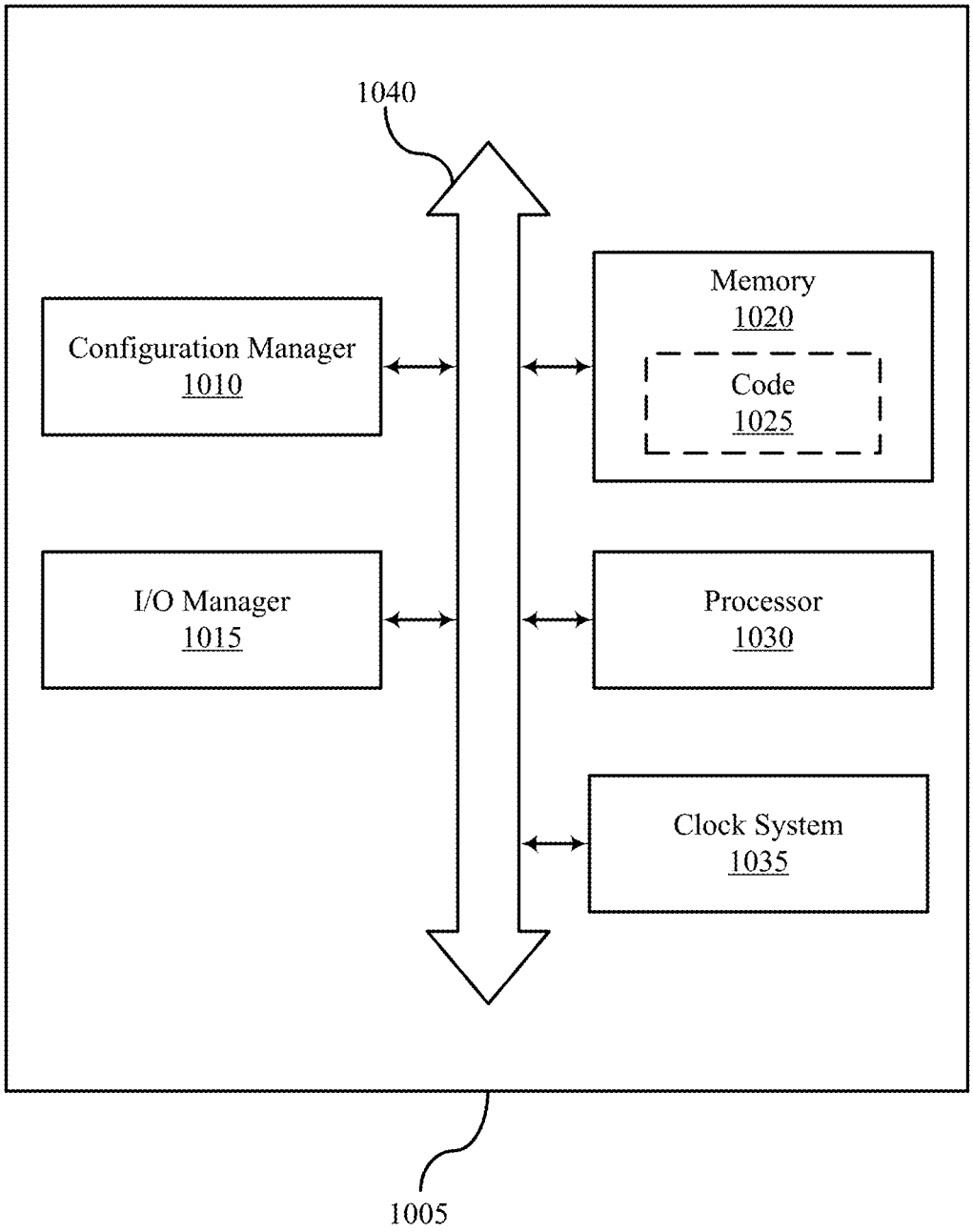
FIG. 10 illustrates an example of a system that supports managing user-authenticated guns.

FIG. 10 illustrates an example of a system 1000 that supports managing user-authenticated guns. The device 1005 may be operable to implement the techniques, technology, or systems disclosed herein. The device 1005 may include components such as a configuration manager 1010, an input/output (I/O) manager 1015, memory 1020, code 1025, a processor 1030, a clock system 1035, and a bus 1040. The components of the device 1005 may communicate via one or more buses 1040. The device 1005 may be an example of, or include components of, a configuration device. For example, the device 1005 may be an aspect of a computer that is capable of communicating with one or more user-authenticated guns. As another example, the device 1005 may be an aspect of a gun that is capable of communicating with one or more user-authenticated guns.

The configuration manager 1010 may determine that an administrator is authorized to configure a gun by matching first query data to first enrollment data. The first enrollment data may be stored in the memory 1020. In some examples, the first enrollment data may be a transformed version of enrollment data. The configuration manager 1010 may generate a user interface that includes multiple assets representing multiple guns, collect user input via the user interface, where the user input indicates that the operator is permitted to operate the gun, generate a configuration message in response to the user input, where the configuration message includes second enrollment data associated with the operator, and transmit the configuration message to the gun. The configuration message may be transmitted to the gun over a wired communication channel or over a wireless communication channel. For example, the I/O manager 1015 may transmit the configuration message to the gun.

The I/O manager 1015 may manage input and output signals for the device 1005. The I/O manager 1015 may also manage various peripherals such an input device (e.g., a button, a switch, a touch screen, a dock, a biometric sensor, a pressure sensor, a heat sensor, a proximity sensor, an RFID sensor, etc.) and an output device (e.g., a monitor, a display, an LED, a speaker, a haptic motor, a heat pipe, etc.).

The memory 1020 may include or store code (e.g., software) 1025. The memory 1020 may include volatile memory, such as random-access memory (RAM) and/or non-volatile memory, such as read-only memory (ROM). The code 1025 may be computer-readable and computer-executable, and when executed, the code 1025 may cause the processor 1030 to perform various operations or functions described here.

The processor 1030 may be an example or component of a central processing unit (CPU), an ASIC, or a field programmable gate array (FPGA). In some embodiments, the processor 1030 may utilize an operating system or software such as Microsoft Windows®, iOS®, Android®, Linux®, Unix®, or the like. The clock system 1035 control a timer for use by the disclosed embodiments.

The configuration manager 1010, or its sub-components, may be implemented in hardware, software (e.g., software or firmware) executed by a processor, or a combination thereof. The configuration manager 1010, or its sub-components, may be physically located in various positions. For example, in some cases, the configuration manager 1010, or its sub-components may be distributed such that portions of functions are implemented at different physical locations by one or more physical components.

Figure 11:
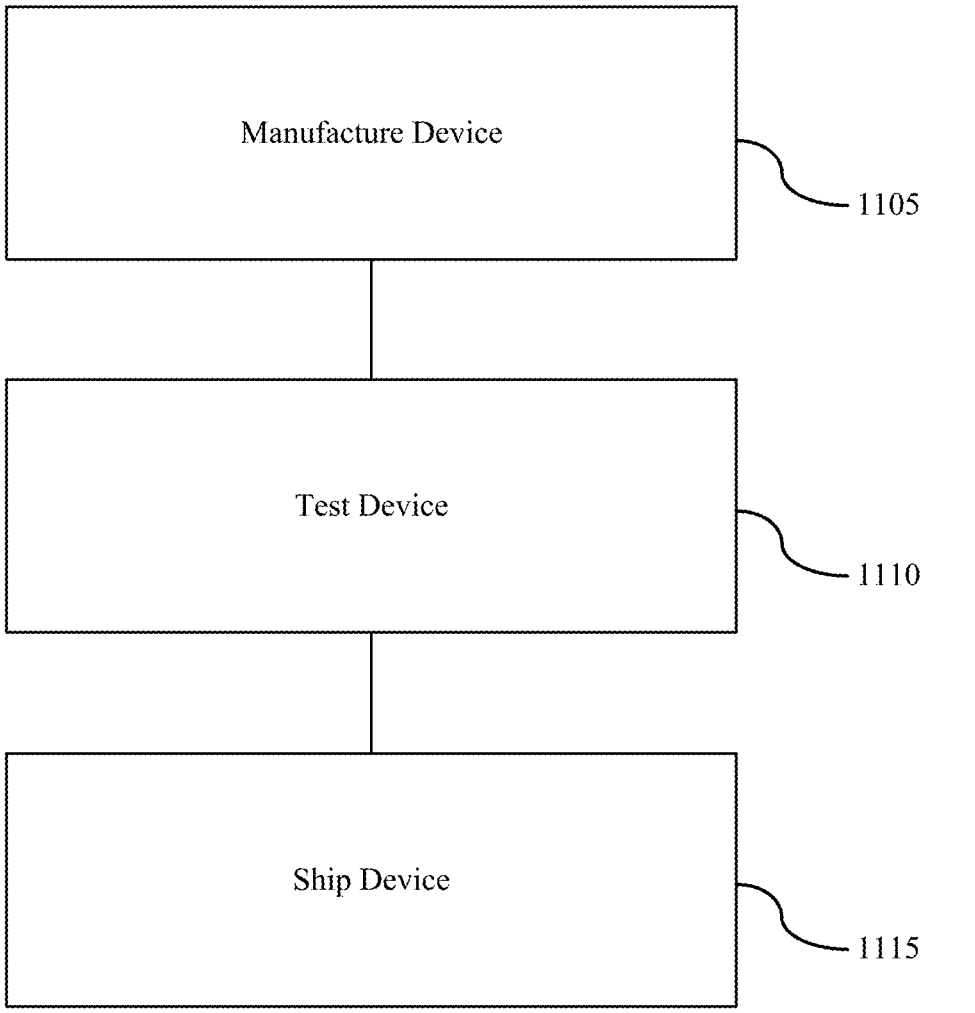
FIG. 11 illustrates an example of a flowchart showing a method of manufacturing a configuration device.

FIG. 11 illustrates an example of a flowchart 1100 showing a method of manufacturing a configuration device that supports configuring aspects of guns. Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Initially, a device manufacturer (or simply "manufacturer") may manufacture a device that is able to implement aspects of the present disclosure (step 1105). For example, the manufacturer may machine, cut, shape, or otherwise make parts to be included in the device. Thus, the manufacturer may also design those parts before machining occurs, or the manufacturer may verify designs produced by another entity before machining occurs. The device may include, or be an aspect of, a computer, a processing system, a docking station, a smartphone, a tablet, or a gun.

Additionally or alternatively, the manufacturer may obtain parts that are manufactured by one or more other entities. Thus, the manufacturer may manufacture the device from components produced entirely by the manufacturer, components produced by other entities, or a combination thereof. Often, the manufacturer will obtain some parts and make other parts that are assembled together to form the device (or a component of the device). The manufacturer or another entity may generate, store, deploy, or otherwise manage cryptographic data associated with a gun. For example, the manufacturer may deploy a cryptographic secret (e.g., a cryptographic key for symmetric cryptographic procedures) into a memory component of the gun to support encryption and decryption at the gun, the manufacturer may deploy a public key into the memory component of the gun to support verifying cryptographic signatures, or the manufacturer may deploy a digital certificate into the memory component of the gun to demonstrate that the signature was created based on the private key associated with the public key, thereby suggesting the authenticity of the public key.

In some embodiments, the manufacturer also generates identifying information related to the device. For example, the manufacturer may etch (e.g., mechanically or chemically), engrave, or otherwise append identifying information onto the device itself. As another example, the manufacturer may encode at least some identifying information into a data structure that is associated with the device. For instance, the manufacturer may etch a serial number onto the device, and the manufacturer may also populate the serial number (and other identifying information) into a data structure for recording or tracking purposes. Examples of identifying information include the make of the device, the model of the device, the serial number, and the like. In some cases, the manufacturer may record a limited amount of identifying information (e.g., only the make and model), while in other cases the manufacturer may record a larger amount of identifying information.

The manufacturer may then test the device (step 1110). In some embodiments, the manufacturer tests all of the devices that are manufactured. In other embodiments, the manufacturer tests a subset of the devices that are manufactured. For example, the manufacturer may randomly or semi-randomly select devices for testing, or the manufacturer may select devices for testing in accordance with a predefined pattern (e.g., one test per 5 devices, 10 devices, or 100 devices). Moreover, the manufacturer may test the device in its entirety, or the manufacturer may test a subset of its components. For example, the manufacturer may test the component(s) that it manufactures. As another example, the manufacturer may test newly designed components or randomly selected components. Thus, the manufacturer could test select component(s) of the device, or the manufacturer could test the device as a whole. For example, the manufacturer may test the data store to verify that it meets a reliability threshold and a wireless communication interface to verify that it meets a speed threshold.

Thereafter, the manufacturer may ship the device to a dealer (step 1115). In the event that the device is a firearm, the manufacturer may ship the device to a Federal Firearms Licensed (FFL) dealer. For example, a purchaser (also referred to as a "customer") may purchase the apparatus through a digital channel or non-digital channel. Examples of digital channels include web browsers, mobile applications, and desktop applications, while examples of non-digital channels include ordering via the telephone and ordering via a physical storefront. In such a scenario, the gun may be shipped to the FFL dealer so that the purchaser can obtain the gun from the FFL dealer. The FFL dealer may be directly or indirectly associated with the manufacturer of the gun. For example, the FFL dealer may be a representative of the manufacturer, or the FFL dealer may sell and distribute guns on behalf of the manufacturer (and possibly other manufacturers). In some examples, the manufacturer may ship the device to a law enforcement agency.

Note that while the sequences of the steps performed in the processes described herein are exemplary, the steps can be performed in various sequences and combinations. For example, steps could be added to, or removed from, these processes. Similarly, steps could be replaced or reordered. As an example, the manufacturer may iteratively test components while manufacturing the device, and therefore perform multiple iterations of steps 1105 and 1110 either sequentially or simultaneously (e.g., one component may be tested while another component is added to the device). Thus, the descriptions of these processes are intended to be open ended.

Figure 12:
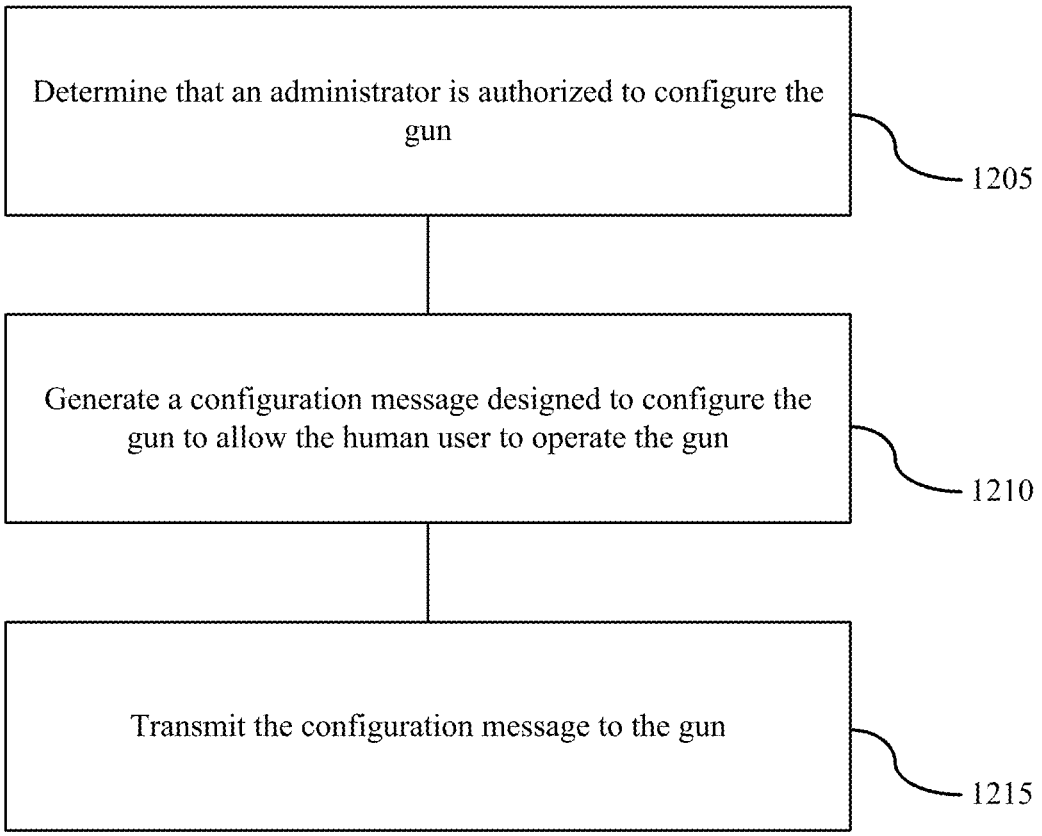
FIG. 12 illustrates an example of a flowchart showing a method of configuring a gun.

FIG. 12 shows a flowchart illustrating a method 1200 of configuring a gun. The operations of the method 1200 may be implemented by a configuration device or its components as described herein. For example, the operations of the method 1200 may be performed by a computer, a tablet, a smartphone, or the like. As an illustrative example, the operations of the method 1300 may be performed by the device 205 as described with reference to FIG. 2. In some examples, a configuration device may execute a set of instructions to control the functional elements of the to perform the described functions. Additionally or alternatively, the configuration device may perform aspects of the described functions using special-purpose hardware.

At step 1205, the device may determine that an administrator is authorized to configure a gun. The device may determine that the administrator is authorized to configure the gun be performing a user authentication procedure and determining that the administrator is in possession of credentials. The credentials may include biometric data, token data, or both. The administrator may provide user input to the device indicating that a human user is assigned to a gun.

At step 1210, the device may generate a configuration message designed to configure the gun to allow the human user to operate the gun. The configuration message may be designed to cause the gun to be configured such that the human user is able to operate the gun. For example, the configuration message may indicate that the human user is an authorized user of the gun. In some examples, the human user may work in law enforcement.

At step 1215, the device may transmit the configuration message to the gun. The device may be electronically coupled with the gun via a wired or wireless communication channel. In some examples, the configuration message may be transmitted to multiple guns, and the multiple guns may be operable for the human user.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Figure 13:
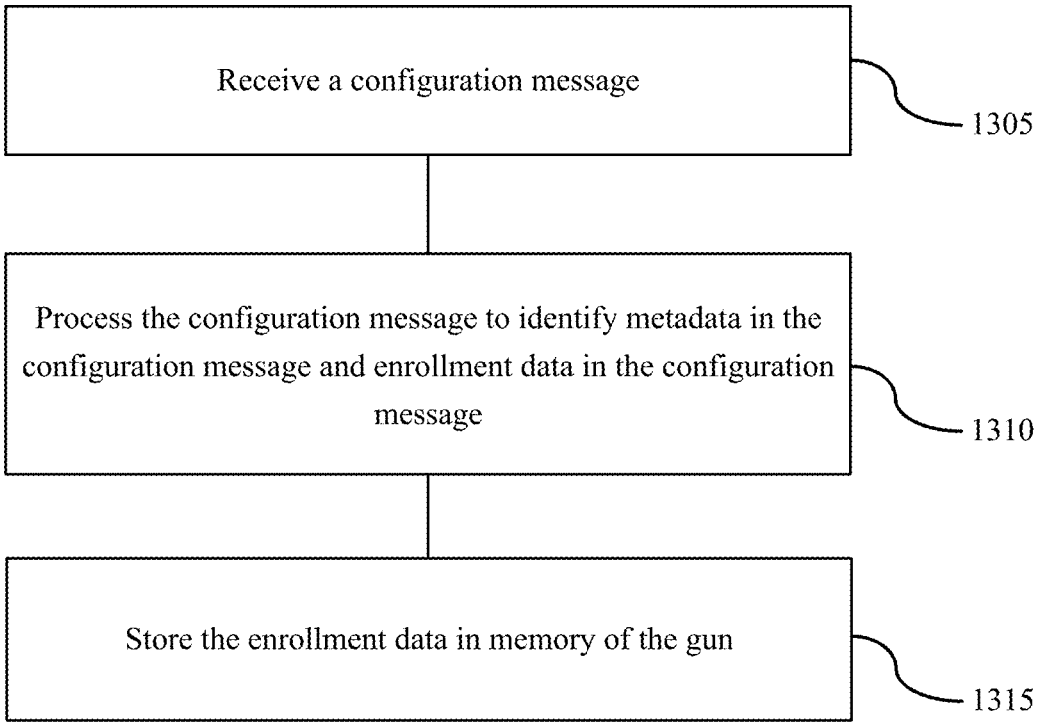
FIG. 13 illustrates an example of a flowchart showing a method of configuring a gun.

FIG. 13 shows a flowchart illustrating a method 1300 of configuring a gun. The operations of the method 1300 may be implemented by a gun or its components as described herein. As an illustrative example, the operations of the method 1300 may be performed by the gun 210 as described with reference to FIG. 2. In some examples, a gun may execute a set of instructions to control the functional elements of the to perform the described functions. Additionally or alternatively, the gun may perform aspects of the described functions using special-purpose hardware.

At step 1305, a gun may receive a configuration message. The gun may be a user-authenticated gun, and the configuration message may be received over a wired or wireless communication interface. The configuration message may be in encrypted form and the gun may perform a cryptographic procedure using a cryptographic key to transform the configuration message into unencrypted form. In some examples, the gun may possess a private key and public key pair, the configuration message may be encrypted using the public key, and the gun may use the private key to transform the configuration message into unencrypted form.

At step 1310, The gun may process the configuration message to identify metadata in the configuration message and enrollment data in the configuration message. The metadata may include a cryptographic signature produced by a configuration device. The enrollment data may be associated with a human user.

At step 1315, the gun may store the enrollment data in memory of the gun. The enrollment data may include biometric data that has been transformed according to a one way function. The enrollment data may additionally or alternatively include token data. The enrollment data may be stored in encrypted form.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Examples

Several aspects of the present disclosure are set forth examples. Note that, unless otherwise specified, all of these examples can be combined with one another. Accordingly, while a feature may be described in the context of a given example, the feature may be similarly applicable to other examples.

In some examples, the techniques described herein relate to a method of remotely configuring a gun such that the gun is operable for select users, the method including: determining, by matching first query data to first enrollment data, that an administrator is authorized to configure the gun; generating, in response to the determining that the administrator is authorized to configure the gun, a user interface including multiple digital assets, wherein each digital asset of the multiple digital assets represents a respective human user; collecting, via the user interface, user input from the administrator indicating that a human user, represented by a digital asset of the multiple digital assets, is selected as an authorized operator of the gun; retrieving, from a data store and in response to the user input, second enrollment data that is associated with the human user; generating, in response to the user input, a configuration message including the second enrollment data; and transmitting the configuration message to the gun, wherein the configuration message is designed to configure the gun to allow the human user to operate the gun and prevent other human users from operating the gun.

In some examples, the techniques described herein relate to a method of configuring a gun, the method including: determining, by matching first query data to first enrollment data, that an administrator is authorized to configure the gun; collecting, via a user interface, user input from the administrator indicating that a human user is selected as an authorized operator of the gun; generating, in response to the user input, a configuration message designed to configure the gun to allow the human user to operate the gun; and transmitting the configuration message to the gun.

In some examples, the techniques described herein relate to a method, wherein the first query data includes first biometric query data, and wherein the first enrollment data includes first biometric enrollment data, the method further including: calculating a similarity score representing the similarity of the first biometric query data and the first biometric enrollment data; and determining that the similarity score satisfies a similarity threshold, wherein the determining that the administrator is authorized to configure the gun is in response to the determining that the similarity score satisfies the similarity threshold.

In some examples, the techniques described herein relate to a method, wherein the first query data includes first token query data, and wherein the first enrollment data includes first token enrollment data, the method further including: determining that the first token query data is the same as the first token enrollment data, wherein the determining that the administrator is authorized to configure the gun is in response to the determining that the first token query data is the same as the first token enrollment data.

In some examples, the techniques described herein relate to a method, further including: retrieving, from a data store, second enrollment data that is associated with the human user, wherein the configuration message includes the second enrollment data.

In some examples, the techniques described herein relate to a method, wherein the second enrollment data is in encrypted form having been encrypted using an encryption key, and wherein the configuration message is in encrypted form having been encrypted using another encryption key that is different from the encryption key.

In some examples, the techniques described herein relate to a method, further including: generating, in response to the determining that the administrator is authorized to configure the gun, a user interface including multiple digital assets, wherein each digital asset of the multiple digital assets represents a respective human user, and wherein the human user is represented by a digital asset of the multiple digital assets.

In some examples, the techniques described herein relate to a method, further including: generating, in response to the determining that the administrator is authorized to configure the gun, a user interface including multiple digital assets, wherein each digital asset of the multiple digital assets represents a respective gun, and wherein the gun is represented by a digital asset of the multiple digital assets.

In some examples, the techniques described herein relate to a method, further including: collecting second enrollment data as part of a user enrollment procedure to enroll the human user as an operator; performing a cryptographic procedure using an encryption key, wherein the cryptographic procedure outputs an encrypted version of the second enrollment data; and storing the encrypted version of the second enrollment data in a data store.

In some examples, the techniques described herein relate to a method, wherein the second enrollment data includes biometric data including fingerprint data, palmprint data, vein pattern data, facial data, iris data, voice data, or any combination thereof.

In some examples, the techniques described herein relate to a method, wherein the second enrollment data includes token data including a digital signature, radio-frequency identification data, near field communication (NFC) data, a Bluetooth token, or any combination thereof.

In some examples, the techniques described herein relate to a method of configuring a gun to be operable for a human user, the method including: receiving a configuration message that is in encrypted form; processing the configuration message, wherein the processing includes: performing a cryptographic procedure using an encryption key stored on the gun, wherein the cryptographic procedure outputs an unencrypted version of the configuration message, identifying metadata in the unencrypted version of the configuration message, and identifying encrypted enrollment data in the unencrypted version of the configuration message; and storing, in memory of the gun, the encrypted enrollment data with an indication that the encrypted enrollment data is associated with an authorized operator of the gun.

In some examples, the techniques described herein relate to a method, further including: modifying an authentication procedure to i) perform a cryptographic procedure using another encryption key, wherein the cryptographic procedure outputs an unencrypted version of the enrollment data, and ii) determine whether collected query data matches the unencrypted version of the enrollment data.

In some examples, the techniques described herein relate to a method, wherein the collected query data matches the unencrypted version of the enrollment data based on a similarity score satisfying a similarity threshold.

In some examples, the techniques described herein relate to a method, further including: modifying an authentication procedure by setting a similarity threshold, wherein the gun is configured to unlock in response to calculating a similarity score that satisfies the similarity threshold, and wherein the similarity score represents the similarity of collected query data and an unencrypted version of the enrollment data.

In some examples, the techniques described herein relate to a method, wherein the similarity threshold is a value greater than zero and less than or equal to one.

In some examples, the techniques described herein relate to a method, wherein the encrypted enrollment data includes encrypted biometric data.

In some examples, the techniques described herein relate to a method, wherein the encrypted enrollment data includes encrypted token data.

In some examples, the techniques described herein relate to a method, wherein the gun is configured to receive the configuration message over a wireless communication medium.

In some examples, the techniques described herein relate to a method, wherein the gun is configured to receive the configuration message over a physical communication medium.

Remarks

The Detailed Description provided herein, in connection with the drawings, describes example configurations and does not represent all the examples that may be implemented or that are within the scope of the claims. The term "example" used herein means "serving as an illustration or instance," and not "a preferred example."

The functions described herein may be implemented with a controller. A controller may include a configuration manager, a special-purpose processor, a general-purpose processor, a digital signal processor (DSP), a CPU, a graphics processing unit (GPU), a microprocessor, a tensor processing unit (TPU), a neural processing unit (NPU), an image signal processor (ISP), a hardware security module (HSM), an ASIC, a programmable logic device (such as an FPGA), a state machine, a circuit (such as a circuit including discrete hardware components, analog components, or digital components), or any combination thereof. Some aspects of a controller may be programmable, while other aspects of a control may not be programmable. In some examples, a digital component of a controller may be programmable (such as a CPU), and in some other examples, an analog component of a controller may not be programmable (such as a differential amplifier).

In some cases, instructions or code for the functions described herein may be stored on or transmitted over a computer-readable medium, and components implementing the functions may be physically located at various locations. Computer-readable media includes both non-transitory computer storage media and communication media. A non-transitory storage medium may be any available medium that may be accessed by a computer or component. For example, non-transitory computer-readable media may include RAM, SRAM, DRAM, ROM, EEPROM, flash memory, magnetic storage devices, or any other non-transitory medium that may be used to carry and/or store program code means in the form of instructions and/or data structures. The instructions and/or data structures may be accessed by a special-purpose processor, a general-purpose processor, a manager, or a controller. A computer-readable media may include any combination of the above, and a compute component may include computer-readable media.

In the context of the specification, the term "left" means the left side of the gun when the gun is held in an upright position, where the term "upright position" generally refers to a scenario in which the gun is oriented as if in a high-ready position with the barrel roughly parallel to the ground. The term "right" means the right side of the gun when the gun is held in the upright position. The term "front" means the muzzle end (also referred to as the "distal end") of the gun, and the term "back" means the grip end (also referred to as the "proximal end") of the gun. The terms "top" and "bottom" mean the top and bottom of the gun as the gun is held in the upright position. The relative positioning terms such as "left," "right," "front," and "rear" are used to describe the relative position of components. The relative positioning terms are not intended to be limiting relative to a gravitational orientation, as the relative positioning terms are intended to be understood in relation to other components of the gun, in the context of the drawings, or in the context of the upright position described above.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Although the Detailed Description describes certain embodiments and the best mode contemplated, the technology can be practiced in many ways no matter how detailed the Detailed Description appears. Embodiments may vary considerably in their implementation details, while still being encompassed by the specification. Particular terminology used when describing certain features or aspects of various embodiments should not be taken to imply that the terminology is being redefined herein to be restricted to any specific characteristics, features, or aspects of the technology with which that terminology is associated. In general, the terms used in the following claims should not be construed to limit the technology to the specific embodiments disclosed in the specification, unless those terms are explicitly defined herein. Accordingly, the actual scope of the technology encompasses not only the disclosed embodiments, but also all equivalent ways of practicing or implementing the embodiments.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

What is claimed is:

1. A method of remotely configuring guns such that the guns are operable for select users, the method comprising:

determining, by matching first query data to first enrollment data, that an administrator is authorized to configure the guns;

generating, in response to the determining that the administrator is authorized to configure the guns, a user interface including multiple digital assets, wherein each digital asset of the multiple digital assets represents a respective human user;

collecting, via the user interface, user input from the administrator indicating that (i) a first human user, represented by a first digital asset of the multiple digital assets, is selected as an authorized operator of a first gun and (ii) a second human user, represented by a second digital asset of the multiple digital assets, is selected as an authorized operator of a second gun;

retrieving, from a data store and in response to the user input, second enrollment data that is associated with the first human user and third enrollment data that is associated with the second human user;

generating, in response to the user input, a first configuration message designed to configure the first gun to allow the first human user to operate the first gun, wherein the first configuration message includes the second enrollment data;

generating, in response to the user input, a second configuration message designed to configure the second gun to allow the second human user to operate the second gun, wherein the second configuration message includes the third enrollment data;

transmitting the first configuration message to the first gun, wherein the first configuration message is designed to configure the first gun to allow the first human user to operate the first gun and prevent other human users from operating the first gun; and transmitting the second configuration message to the second gun, wherein the second configuration message is designed to configure the second gun to allow the second human user to operate the second gun and prevent other human users from operating the second gun.

2. A method of configuring a gun, the method comprising:

determining, by matching first query data to first enrollment data, that an administrator is authorized to configure the gun;

collecting, via a user interface, user input from the administrator indicating that a human user is selected as an authorized operator of the gun;

retrieving, from a data store, second enrollment data that is associated with the human user;

generating, in response to the user input, a configuration message designed to configure the gun to allow the human user to operate the gun, wherein the configuration message includes the second enrollment data; and transmitting the configuration message to the gun.

3. The method of claim 2, wherein the first query data includes first biometric query data, and wherein the first enrollment data includes first biometric enrollment data, the method further including:

calculating a similarity score representing similarity of the first biometric query data and the first biometric enrollment data; and determining that the similarity score satisfies a similarity threshold, wherein the determining that the administrator is authorized to configure the gun is in response to the determining that the similarity score satisfies the similarity threshold.

4. The method of claim 2, wherein the first query data includes first token query data, and wherein the first enrollment data includes first token enrollment data, the method further including:

determining that the first token query data is the same as the first token enrollment data, wherein the determining that the administrator is authorized to configure the gun is in response to the determining that the first token query data is the same as the first token enrollment data.

5. The method of claim 2, wherein the configuration message includes an indication of a time window, and wherein the configuration message is designed to further configure the gun to be capable of functioning for then human user during the time window.

6. The method of claim 2, further comprising:

generating, in response to the determining that the administrator is authorized to configure the gun, a user interface including multiple digital assets, wherein each digital asset of the multiple digital assets represents a respective human user, and wherein the human user is represented by a digital asset of the multiple digital assets.

7. The method of claim 2, further comprising:

generating, in response to the determining that the administrator is authorized to configure the gun, a user interface including multiple digital assets, wherein each digital asset of the multiple digital assets represents a respective gun, and wherein the gun is represented by a digital asset of the multiple digital assets.

8. The method of claim 2, further comprising:

collecting the second enrollment data as part of a user enrollment procedure to enroll the human user as an operator;

performing a cryptographic procedure using an encryption key, wherein the cryptographic procedure outputs an encrypted version of the second enrollment data; and storing the encrypted version of the second enrollment data in a data store.

9. The method of claim 8, wherein the second enrollment data includes biometric data including fingerprint data, palmprint data, vein pattern data, facial data, iris data, voice data, or any combination thereof.

10. The method of claim 8, wherein the second enrollment data includes token data including a digital signature, radio-frequency identification data, near field communication (NFC) data, a Bluetooth token, or any combination thereof.

* * * * *